US010754292B2

(12) United States Patent
Miyoshi et al.

(10) Patent No.: US 10,754,292 B2
(45) Date of Patent: Aug. 25, 2020

(54) IMAGE FORMING APPARATUS

(71) Applicant: CANON KABUSHIKI KAISHA, Tokyo (JP)

(72) Inventors: Takahiro Miyoshi, Yokohama (JP); Shunsuke Hijikata, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/373,168

(22) Filed: Apr. 2, 2019

(65) Prior Publication Data

US 2019/0302687 A1 Oct. 3, 2019

(30) Foreign Application Priority Data

Apr. 3, 2018 (JP) ..... 2018-071422

(51) Int. Cl.
*G03G 21/18* (2006.01)
*G03G 21/16* (2006.01)

(52) U.S. Cl.
CPC ..... *G03G 21/1842* (2013.01); *G03G 21/1647* (2013.01)

(58) Field of Classification Search
CPC ..... G03G 21/1647; G03G 21/1842
See application file for complete search history.

(56) References Cited

U.S. PATENT DOCUMENTS

| | | | | |
|---|---|---|---|---|
| 9,389,584 | B2 | 7/2016 | Uchida et al. | |
| 9,766,588 | B2 | 9/2017 | Uchida et al. | |
| 10,108,141 | B2 | 10/2018 | Uchida et al. | |
| 2010/0202797 | A1* | 8/2010 | Kikuchi | G03G 21/1623 399/111 |
| 2017/0261920 | A1* | 9/2017 | Kawamura | G03G 21/1647 |
| 2018/0329363 | A1 | 11/2018 | Hijikata et al. | |

FOREIGN PATENT DOCUMENTS

JP 2010-266854 A 11/2010

* cited by examiner

*Primary Examiner* — Gregory H Curran
(74) *Attorney, Agent, or Firm* — Venable LLP

(57) ABSTRACT

An image forming apparatus includes a drum cartridge and developing cartridge, which are detachably mounted to a main assembly, and an urging mechanism for urging the cartridges to position them. The urging mechanism 60 includes a single elastic member, a first urging member for transmitting the force of the elastic member to the drum cartridge and a second urging member for transmitting the force to the developer cartridge.

8 Claims, 17 Drawing Sheets

IMAGE FORMING APPARATUS

FIELD OF THE INVENTION AND RELATED ART

The present invention relates to an electrophotographic image forming apparatus (which hereafter will be referred to simply as image forming apparatus). More specifically, it relates to a part of the structural arrangement of the apparatus, which is for positioning the photosensitive drum (electrophotographic photosensitive member) and developing device of the apparatus.

In the field of an image forming apparatus, a cartridge system has long been in use. According to a cartridge system, a photosensitive drum (which hereafter may be referred to simply as drum), and processing means for processing the drum, are integrally placed in a cartridge which is removably installable in the main assembly of an image forming apparatus.

In recent years, various methods have been developed and employed to make the consumables such as a developer and a photosensitive drum for an image forming apparatus replaceable in order to reduce an image forming apparatus in operational cost. According to these methods, an image forming apparatus is structured so that a drum cartridge which contains a photosensitive drum, and a development cartridge which contains developer, are replaceable independently of each other.

Also in recent years, various methods have been developed and employed to improve an image forming apparatus in terms of the efficiency with which it can be transported. According to one of these methods, an image forming apparatus is transported, with a drum cartridge and a development cartridge placed together in the main assembly of an image forming apparatus. Thus, when a user uses such an image forming apparatus for the first time, the user has to take the drum cartridge and development cartridge out of the main assembly of the image forming apparatus, remove the toner seals or the like to ready the process cartridges for image formation, and reinstall the cartridges into the main assembly. This practice of placing drum cartridge and development cartridge together in the main assembly of an image forming apparatus in order to improve the apparatus in transportation efficiency has been increasingly employed.

Since cartridges are installed in the interior of the main assembly of an image forming apparatus before the apparatus is transported to a user, there is such a concern that the drum of the cartridge will be scarred due to the vibrations or the like which occur during the transportation.

Therefore, some image forming apparatuses are structured so that as a drum cartridge and a development cartridge are placed together in the main assembly of an image forming apparatus, for transportation, the drums come under the pressure generated by the springs with which the main assembly of the apparatus is provided, being thereby prevented from moving during the transportation or the like situation, as disclosed in Japanese Laid-open Patent Application No. 2010-266854 (Patent Document 1).

The image forming apparatus disclosed in Patent Document 1 is structured so that as drum cartridges are placed in the main assembly of the image forming apparatus, for transportation, the drums in the drum cartridges come under the pressure generated by the springs with which the apparatus main assembly is provided. Further, the image forming apparatus is structured so that as the development cartridge is placed in contact with the drum cartridge, the apparatus is increased in the pressure by which the development cartridge is pressed upon the drum cartridge, in order to make it possible for the photosensitive drum to be supplied with the toner from the development cartridge. Further, the apparatus is structured so that as the development cartridge is separated from the drum cartridge, the apparatus is reduced in the pressure by which the photosensitive drum is pressed against the frame of the apparatus main assembly. As the pressure by which the photosensitive drum is pressed on the frame of the apparatus main assembly is reduced, it is possible that the cartridges placed together in the apparatus main assembly will be moved by the vibrations or the like which occur to the apparatus during the transportation or the like situations, and therefore, such problems that the photosensitive drums are scarred will occur.

In order to prevent the occurrence of the problems described above, it is necessary to increase the springs in the amount of force, by which they press the drum cartridges. However, simply increasing these springs in the amount of force they generate increases the apparatus in the amount of force which is necessary to open or close the door of the apparatus, reducing therefore the apparatus in usability.

In the case of the image forming apparatus disclosed in Patent Document 1, in order to ensure that the development cartridge and drum cartridge are pressed by a sufficient amount of pressure, each development cartridge and each drum cartridge are provided with a pair of pressing members. This solution, however, that is, providing each cartridge with a combination of springs and pressing members, requires spaces for these components. Further, when the development cartridge is not in contact with the drum cartridge, the apparatus is smaller in the pressure by which the drum cartridges are pressed. Therefore, the cartridges move in the apparatus main assembly due to the vibrations or the like, which occurs during the transportation or the like situation, making it possible for the photosensitive drums to be scarred, or suffer from the like problem.

SUMMARY OF THE INVENTION

Thus, the primary object of the present invention is to provide a method for keeping both development cartridge and drum cartridge of an image forming apparatus pressed by the same elastic member to reduce the image forming apparatus in size. Another object of the present invention is to provide an image forming apparatus with a sufficient amount of force for keeping a drum cartridge and a development cartridge pressed to prevent the problem that in a case where the apparatus is transported, with its development cartridge and drum cartridge installed together in the main assembly of the apparatus, the drum cartridge is moved by the vibrations or the like, without reducing the apparatus in usability.

According to an aspect of the present invention, there is provided an image forming apparatus for forming an image on a recording material, said image forming apparatus comprising a main assembly; a drum cartridge detachably mountable to said main assembly of said image forming apparatus and including a photosensitive drum; a developing cartridge detachably mountable to said main assembly, said developing cartridge including a developing member configured to carry a developer to develop a latent image on said photosensitive drum; and an urging mechanism configured to urge said drum cartridge and said developing cartridge which are in mount positions inside said main assembly to position them in said main assembly, said urging mechanism including an elastic member, a first urging member including a first urging portion configured to transmit a force of said elastic member to said drum cartridge, and a second urging member including a second urging portion configured to transmit the force of said elastic member to said developing cartridge.

According to another aspect of the present invention, there is provided an image forming apparatus for forming an image on a recording material, said image forming apparatus comprising a main assembly; a process cartridge detachably mountable to said main assembly, said process cartridge integrally including a drum cartridge having a photosensitive drum, and a developing cartridge having a developing member configured to carry a developer to develop a latent image on said photosensitive drum; and an urging mechanism configured to urge said drum cartridge and said developing cartridge of said process cartridge and which is in a mount position inside said main assembly to position it in said main assembly, said urging mechanism including an elastic member, a first urging member including a first urging portion configured to transmit a force of said elastic member to said drum cartridge, and a second urging member including a second urging portion configured to transmit the force of said elastic member to said developing cartridge.

Further features of the present invention will become apparent from the following description of exemplary embodiments with reference to the attached drawings.

BRIEF DESCRIPTION OF THE DRAWINGS

Parts (a), (b) and (c) of FIG. 1 are schematic views illustrating the operation of the mechanism for pressing the development cartridge upon the drum cartridge, and the operation of the mechanism for separating the development cartridge from the drum cartridge, in the first embodiment of the present invention.

Figure 3:
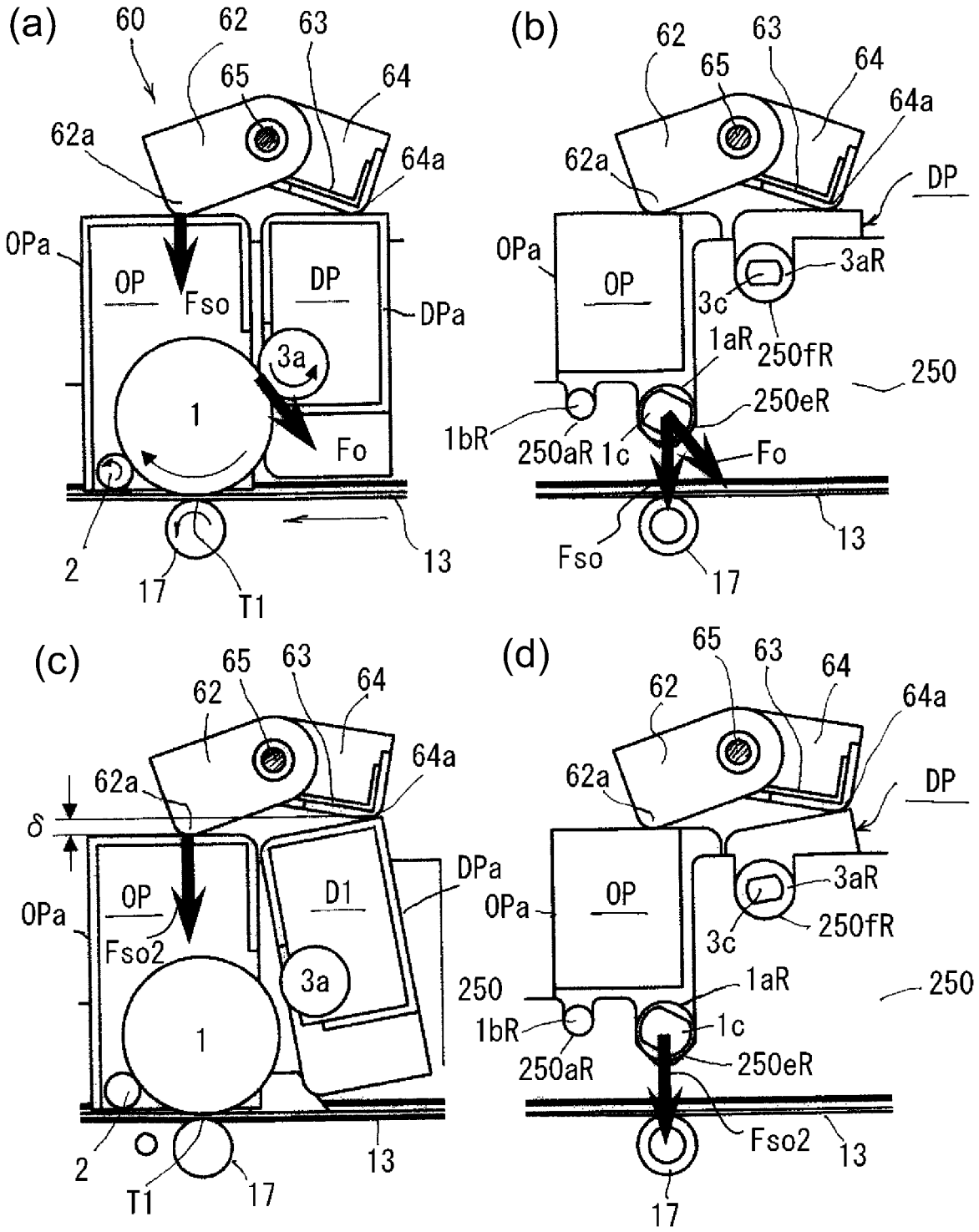

Parts (a), (b), (c) and (d) of FIG. 3 are schematic views illustrating the operation of the pressing mechanism, which occurs when the development cartridge is placed in contact with, or separated from, the drum cartridge.

Figure 4:
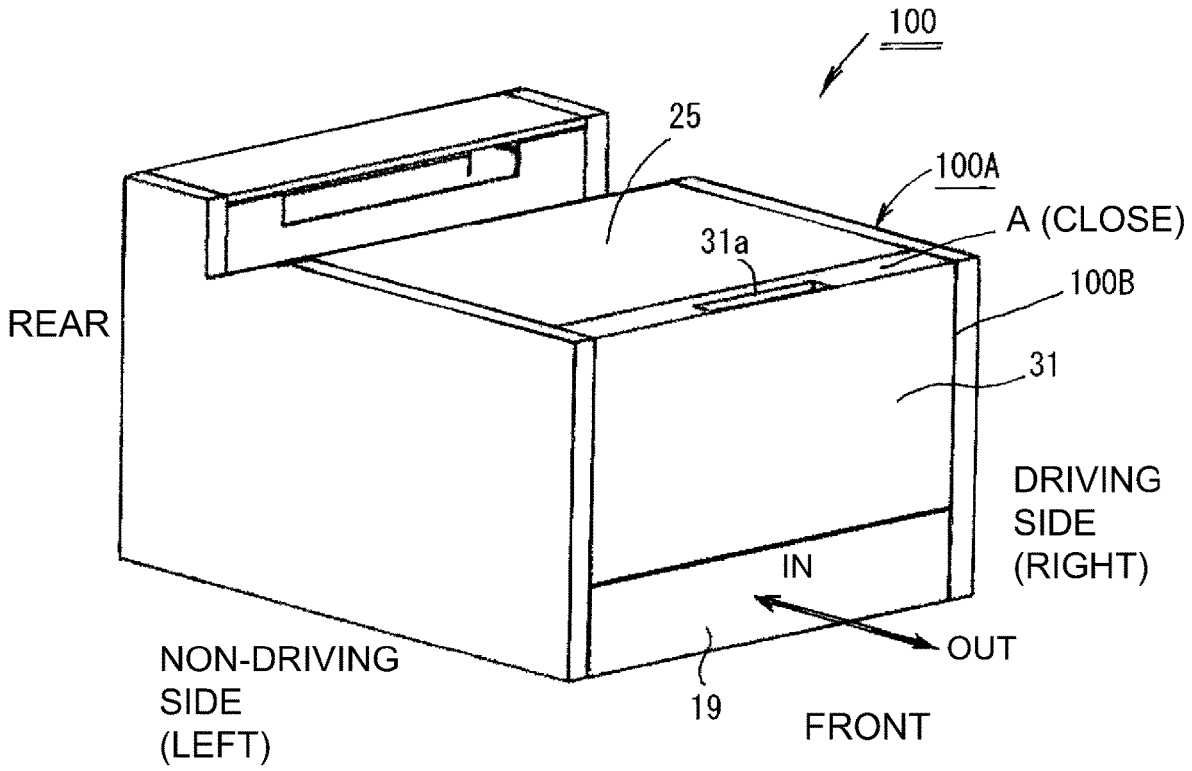

FIG. 4 is an external perspective view of a typical image forming apparatus to which the present invention is applicable.

Figure 5:
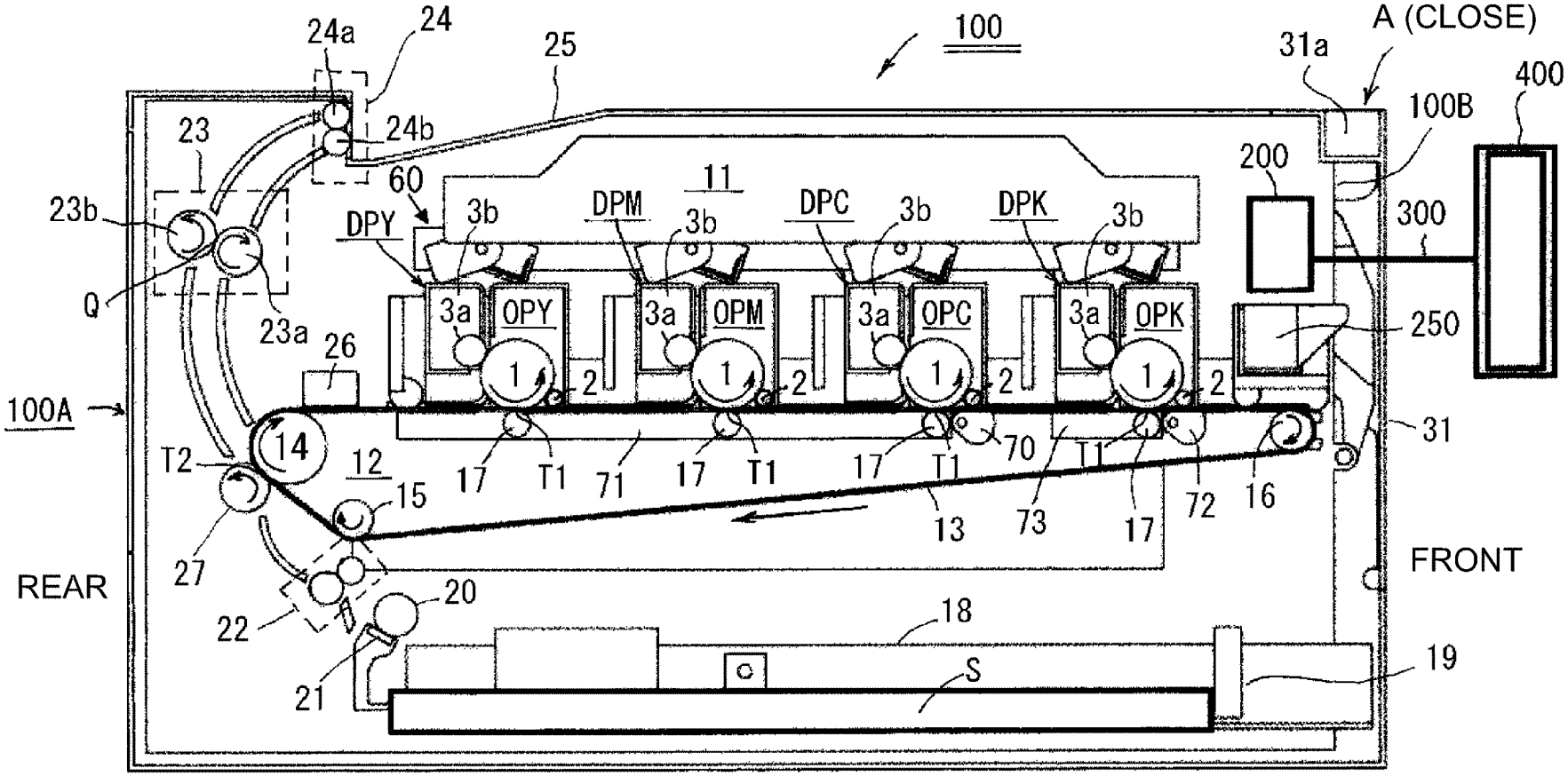

FIG. 5 is a vertical sectional view of the image forming apparatus, in FIG. 5, as seen from the left-hand side of the apparatus.

Figure 6:
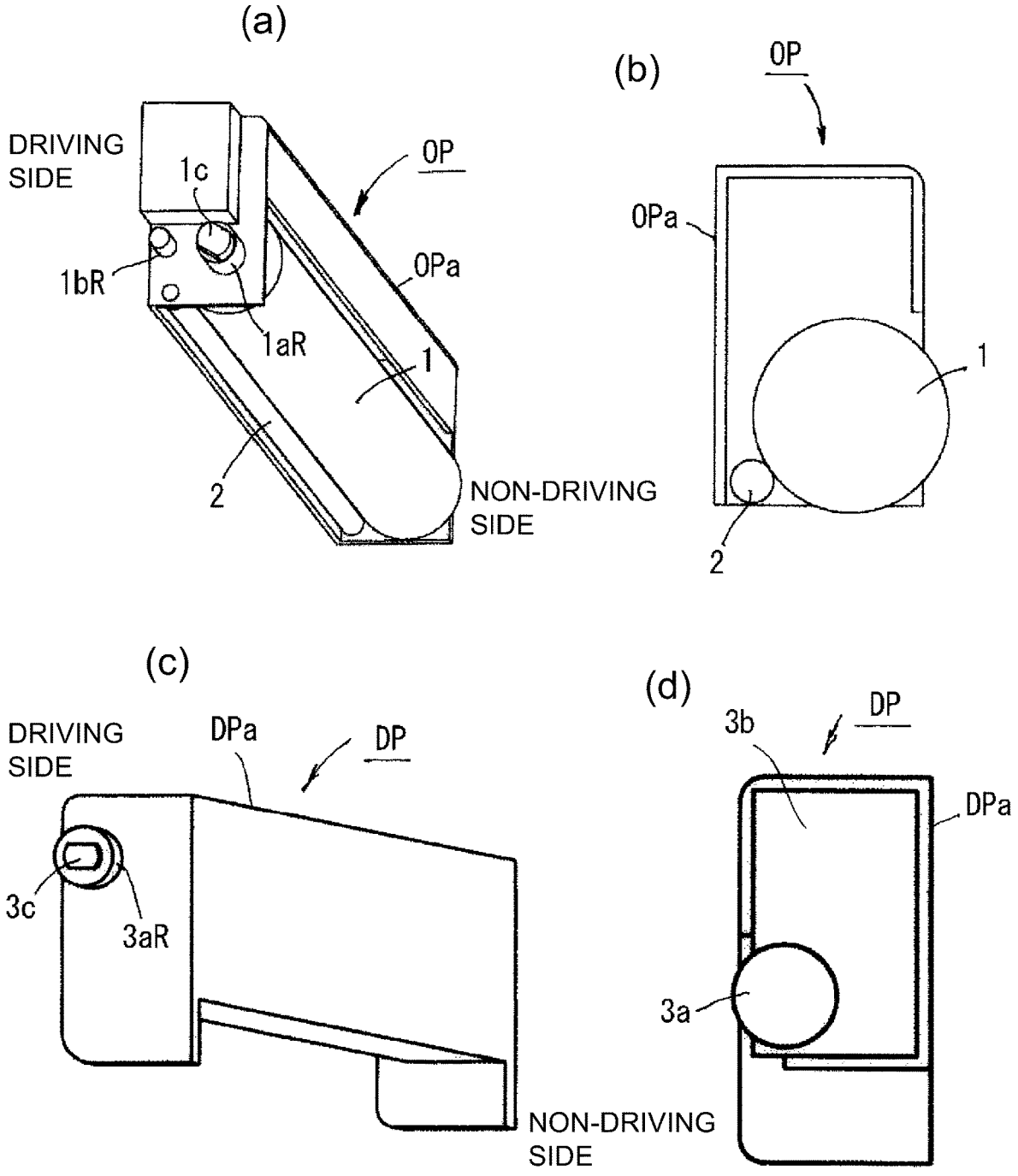

Parts (a), (b), (c) and (d) of FIG. 6 are a combination of perspective and sectional views of a combination of the drum cartridge and development cartridge.

Figure 7:
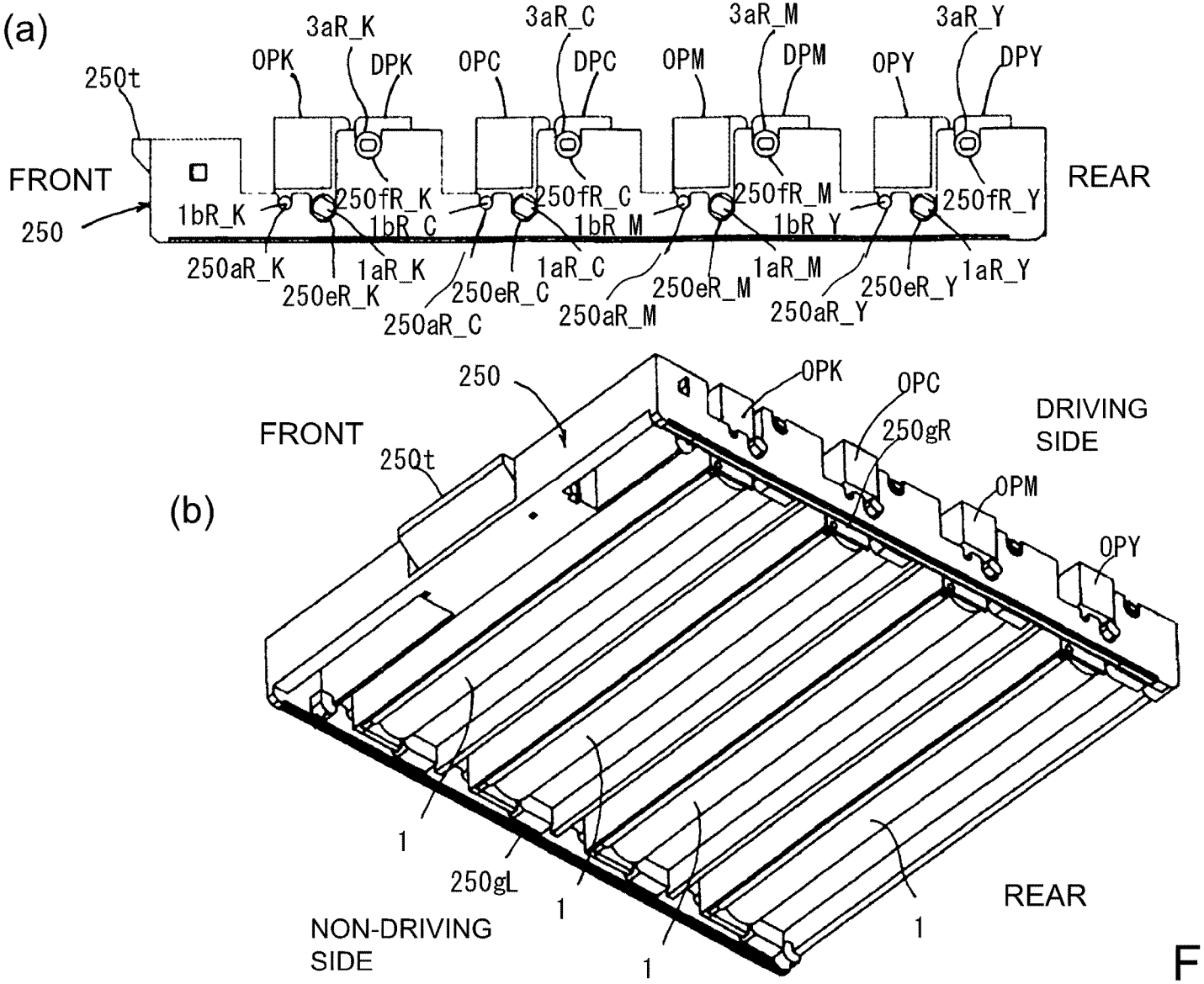

Parts (a) and (b) of FIG. 7 are a combination of side and perspective views of a combination of the drum cartridges and development cartridges, and a cartridge tray which is holding the drum cartridges and development cartridges.

Figure 8:
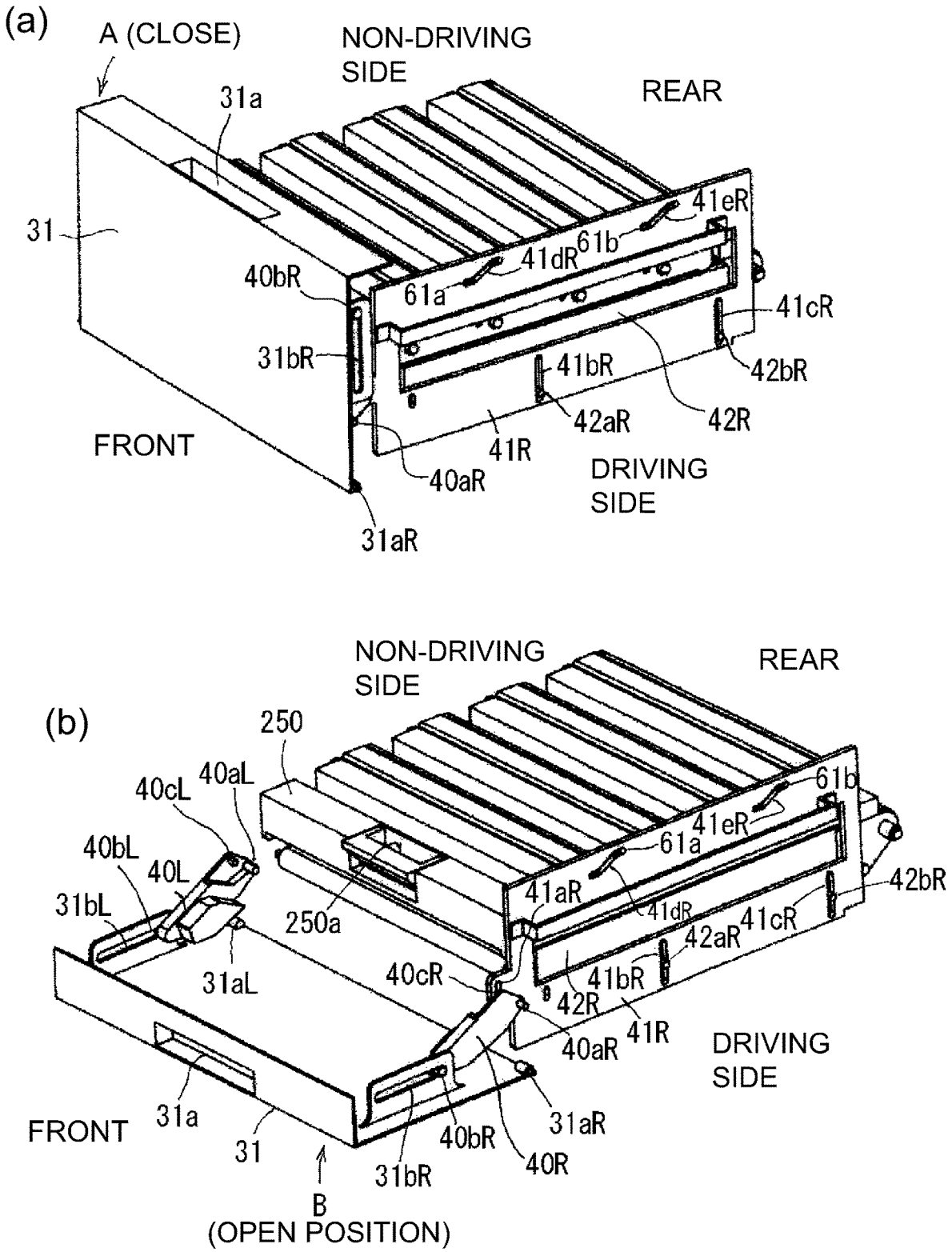

Parts (a) and (b) of FIG. 8 illustrate the opening and closing of the front door, and the resultant movements of the mechanism which is in connection to the front door (1).

Figure 9:
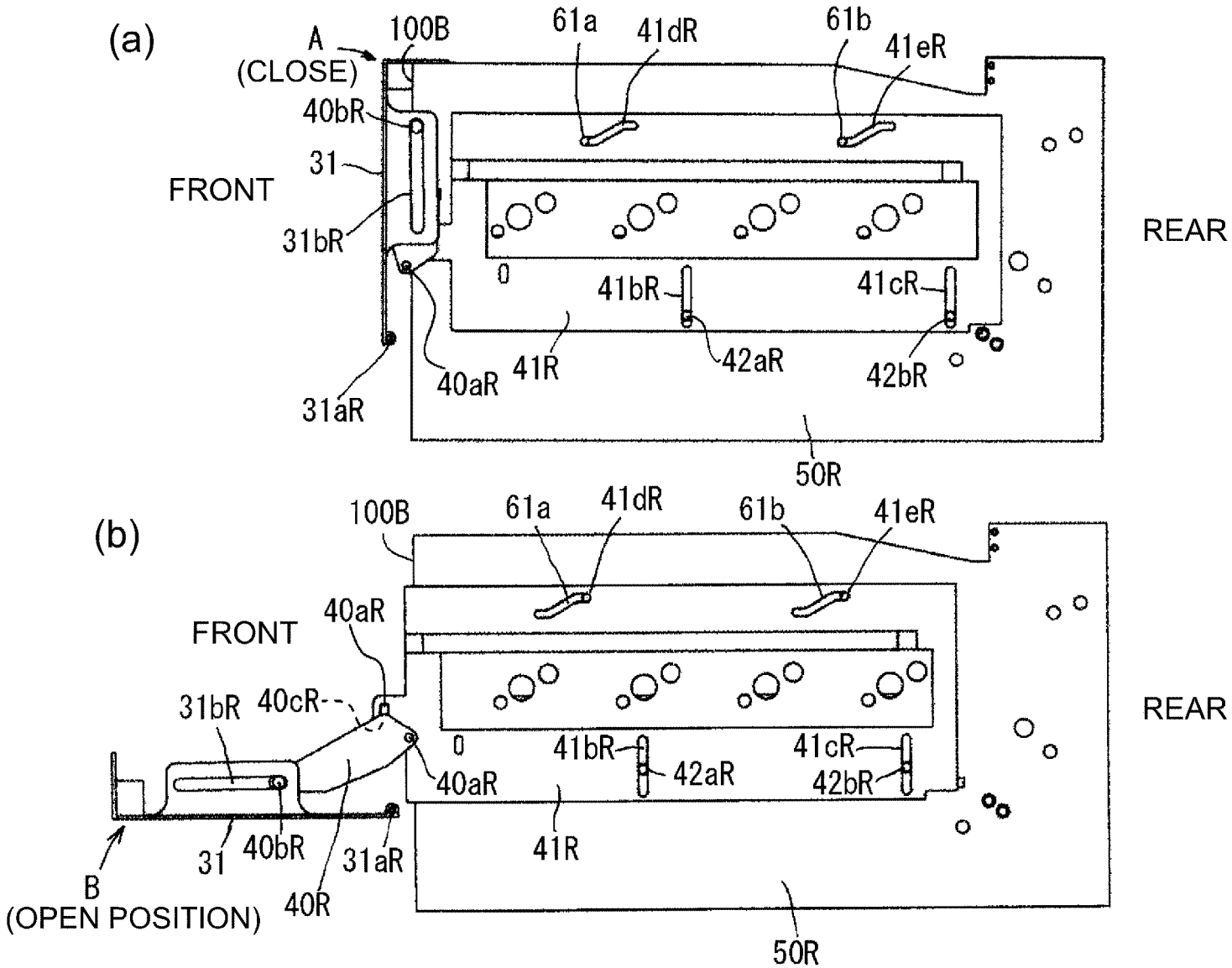

Parts (a) and (b) of FIG. 9 illustrate opening and closing of the front door, and the resultant movements of the mechanism which is in connection to the front door (2).

Figure 10:
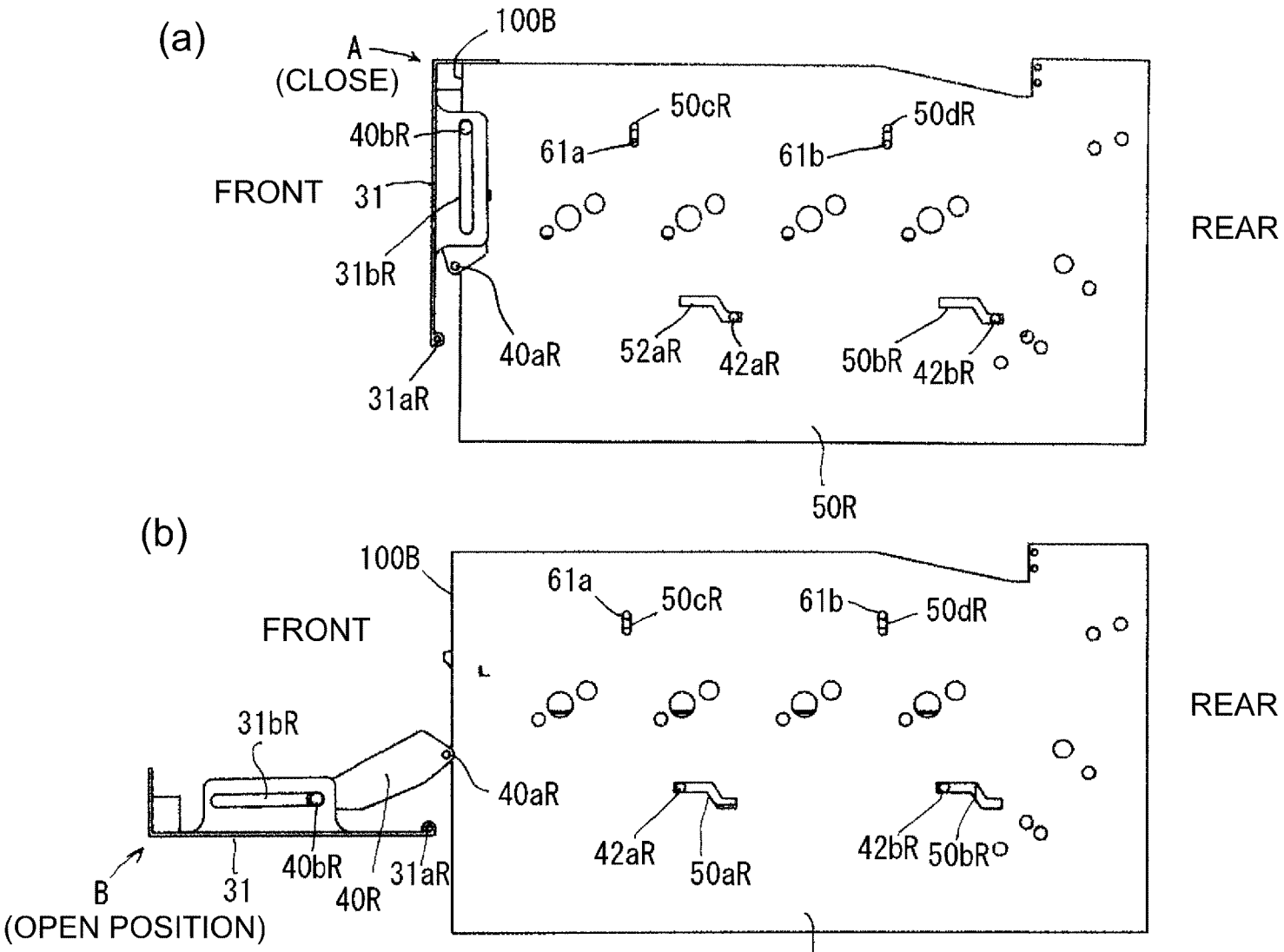

Parts (a) and (b) of FIG. 10 illustrate the opening and closing of the front door, and the resultant movements of the mechanism which is in connection to the front door (3).

Figure 11:
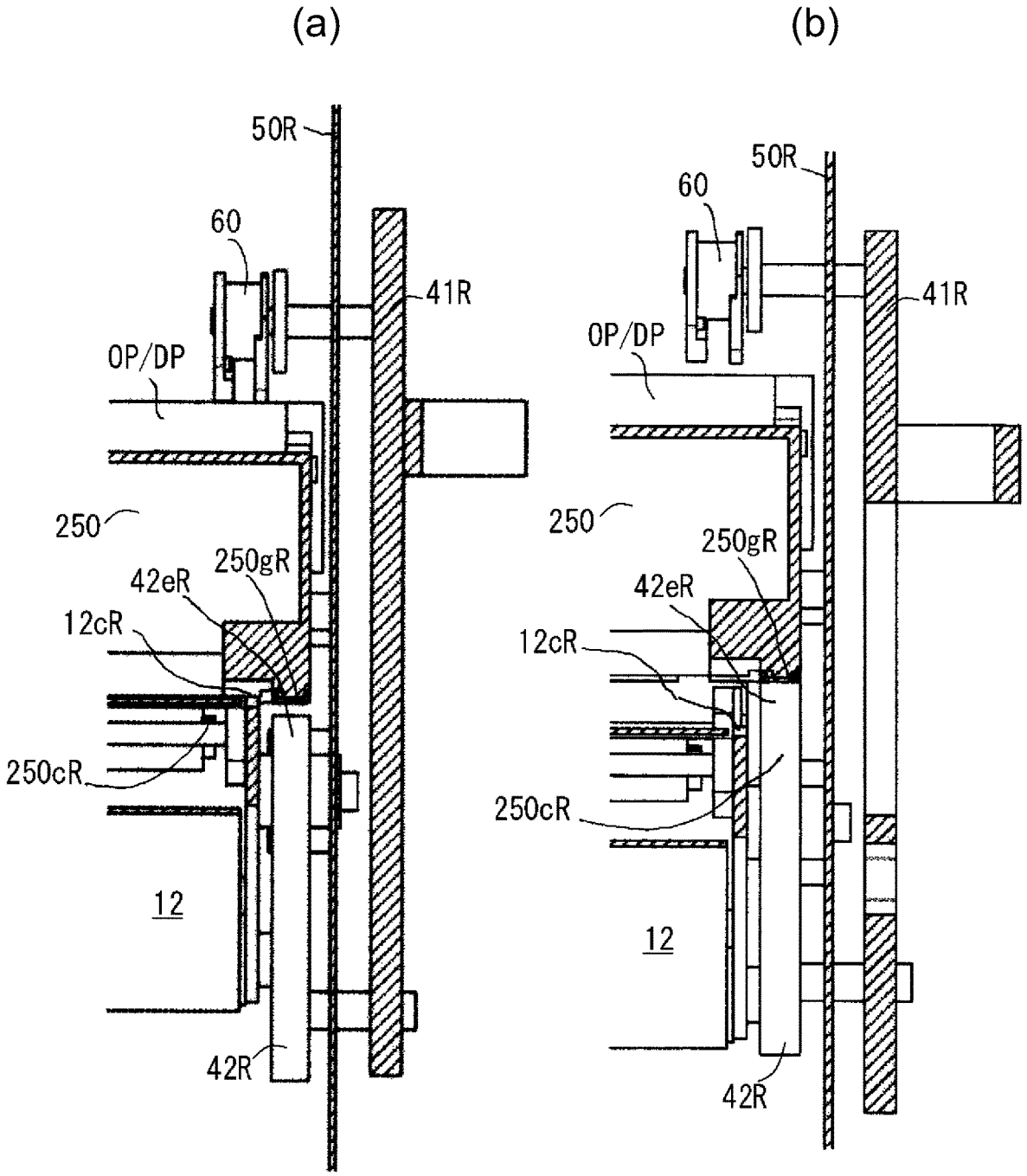

Parts (a) and (b) of FIG. 11 illustrate the opening and closing of the front door, and the resultant movements of the mechanism which is in connection to the front door (4).

Figure 12:
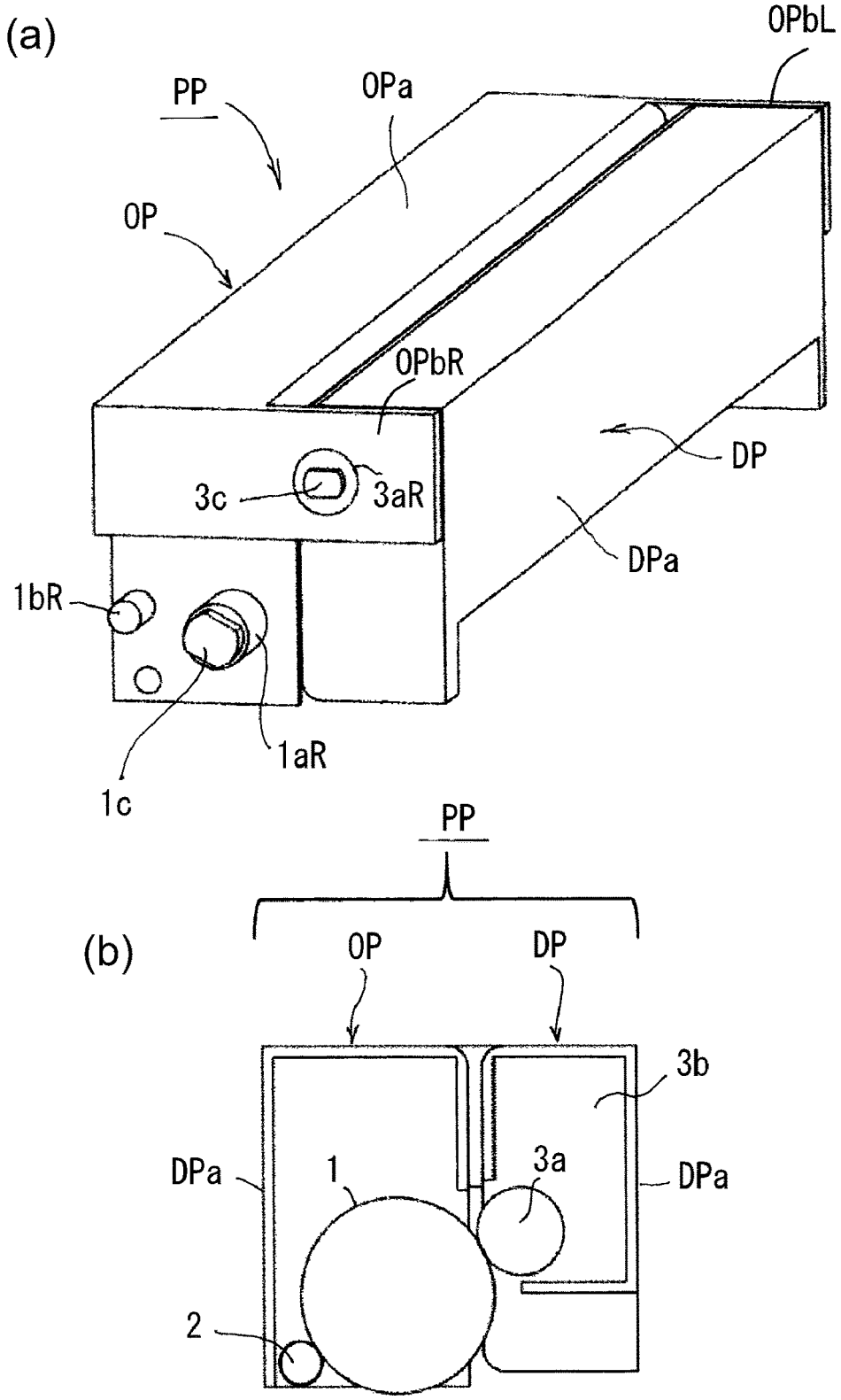

Parts (a) and (b) of FIG. 12 are perspective and sectional views of a combination of the drum cartridge and development cartridge in the second embodiment of the present invention.

Figure 13:
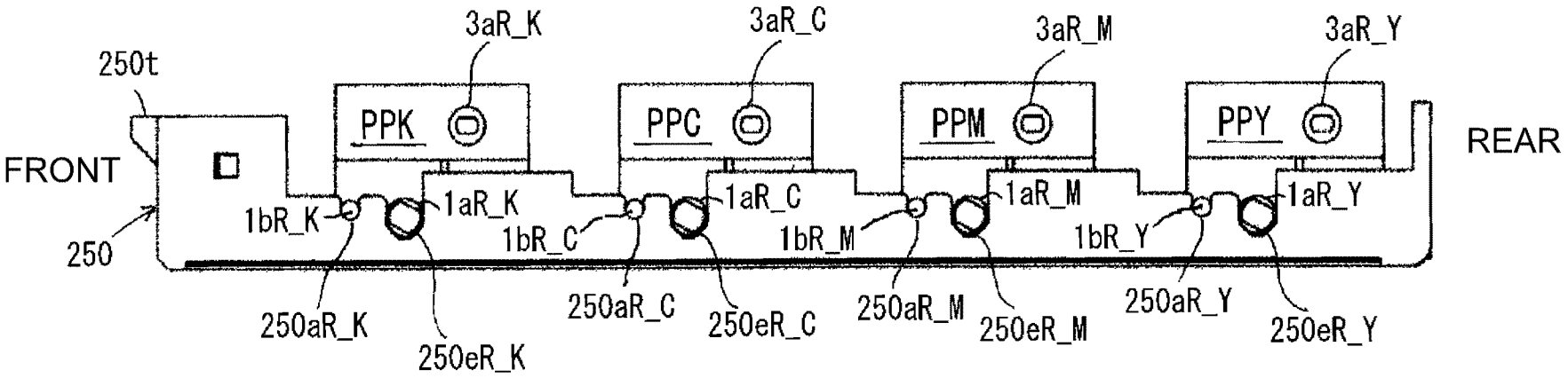

FIG. 13 is a side view of a cartridge tray, and the drum cartridges and development cartridge which are supported by the tray.

Figure 14:
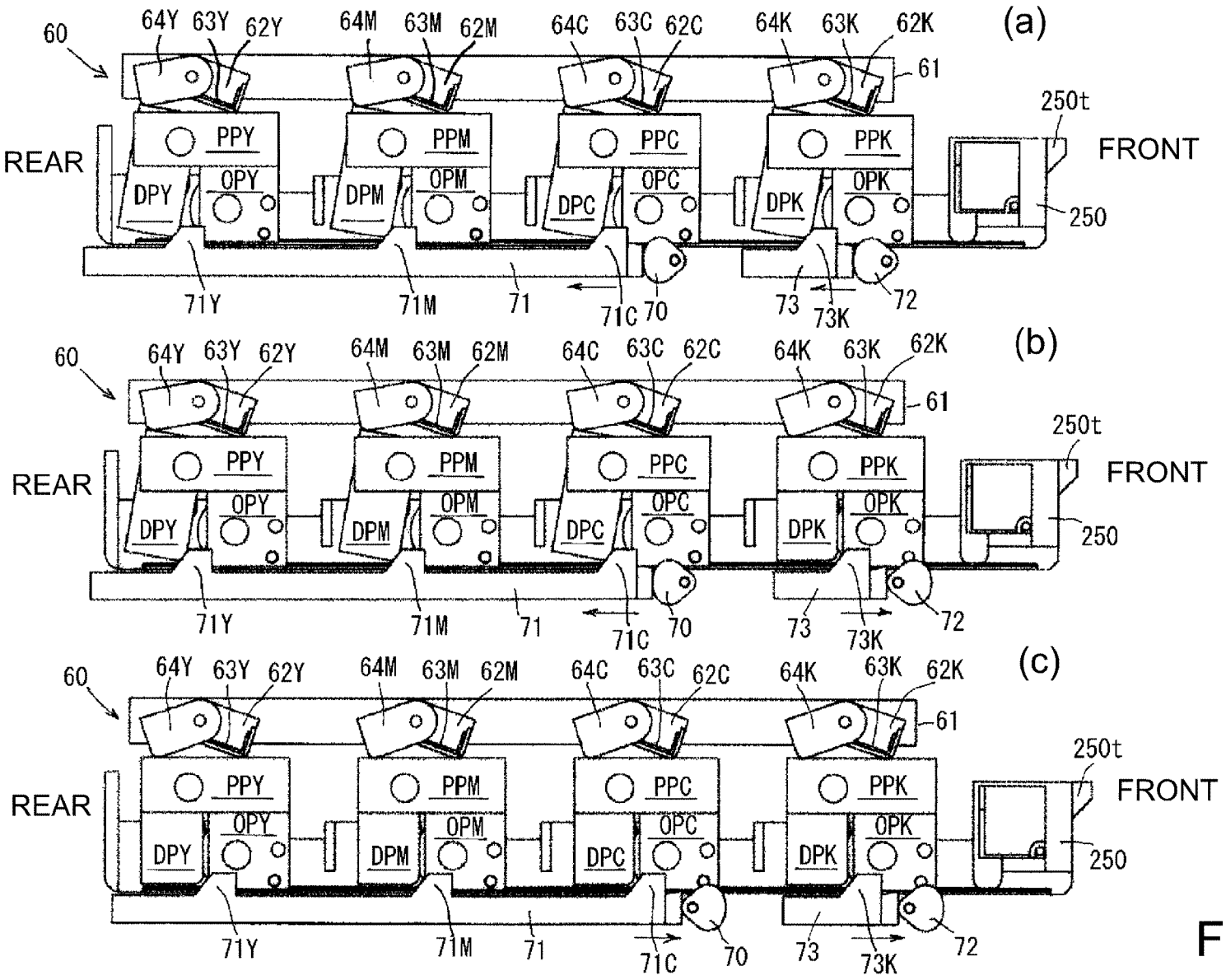

Parts (a), (b) and (c) of FIG. 14 are schematic views illustrating the operation of the pressing mechanism, which occurs when the development cartridge is placed in contact with, or separated from, the drum cartridge.

Figure 15:
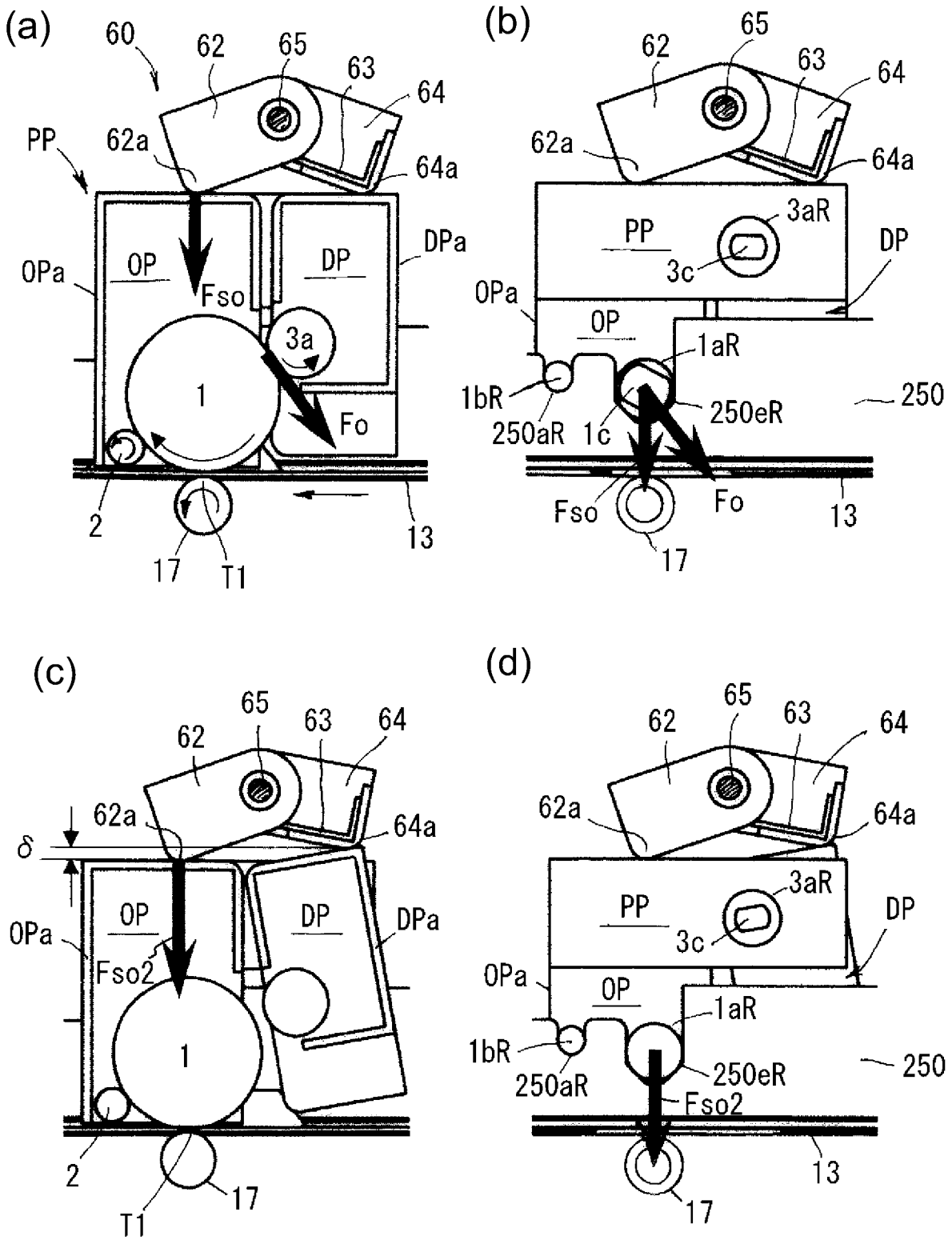

Parts (a), (b), (c) and (d) of FIG. 15 are schematic views illustrating the operation of the pressing mechanism, which occurs when the development cartridge is placed in contact with, or separated from, the drum cartridge.

Figure 16:
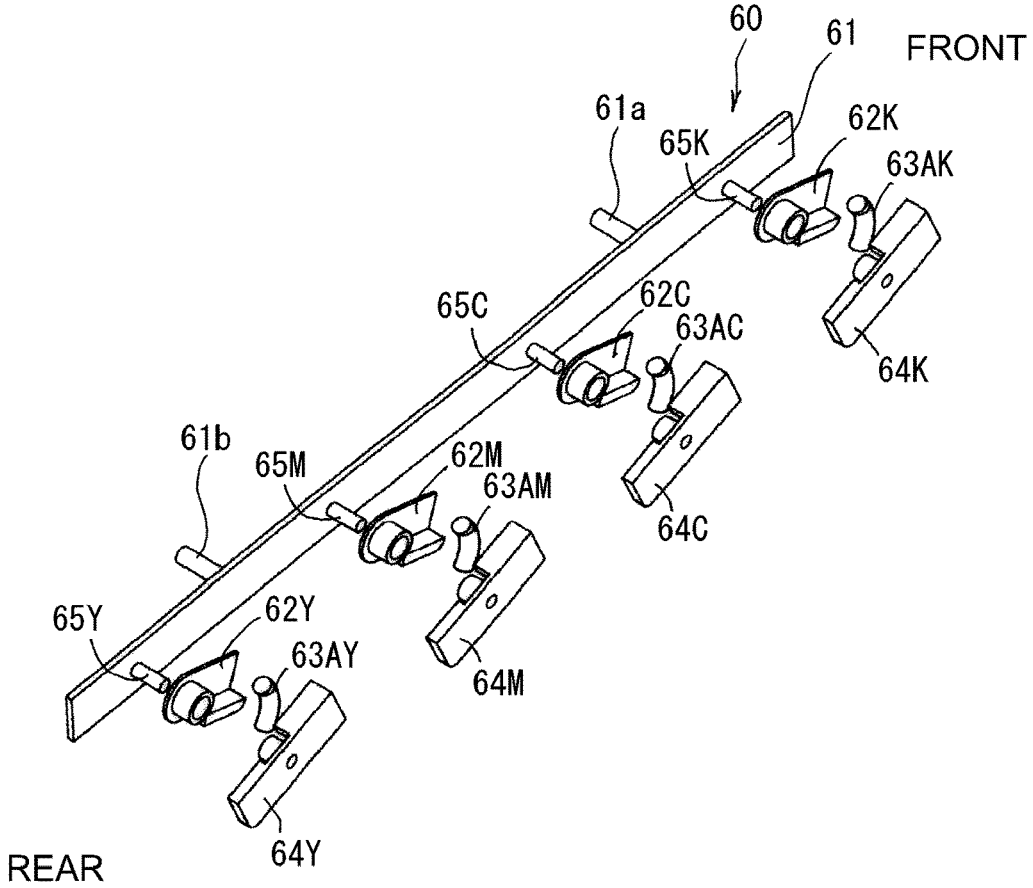

FIG. 16 is an exploded perspective view of the pressing mechanism in the third embodiment.

Figure 17:
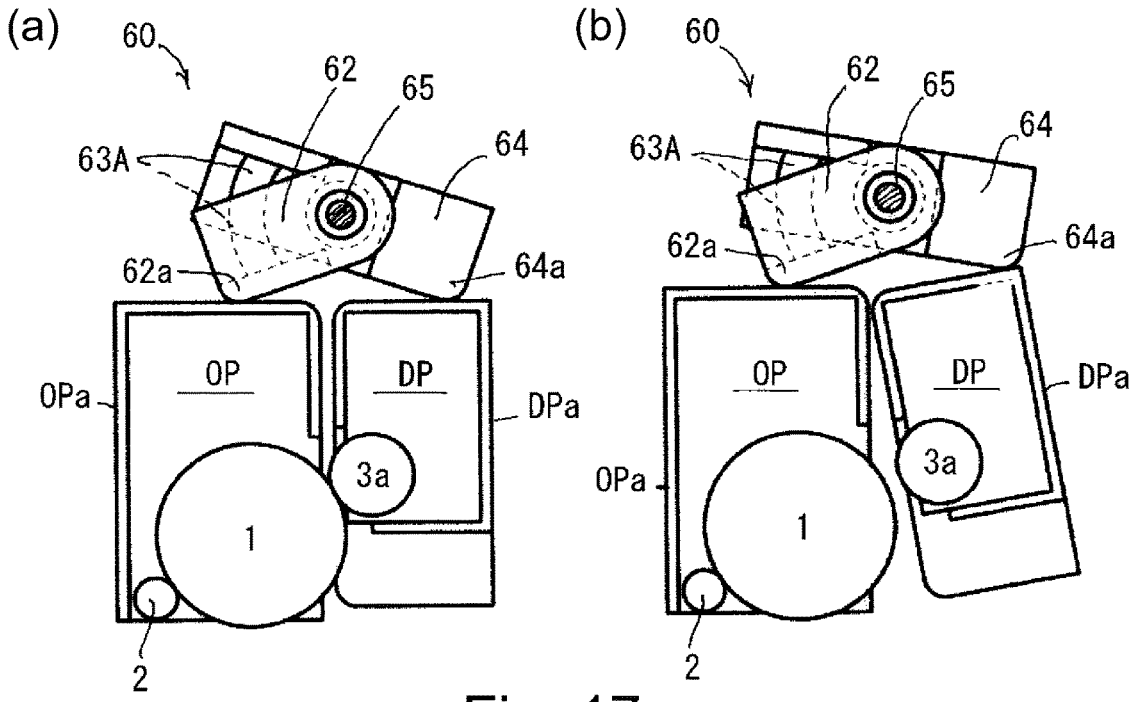

Parts (a) and (b) of FIG. 17 are schematic views illustrating the operation of the pressing mechanism, which occurs when the development cartridge is placed in contact with, or separated from, the drum cartridge.

Figure 18:
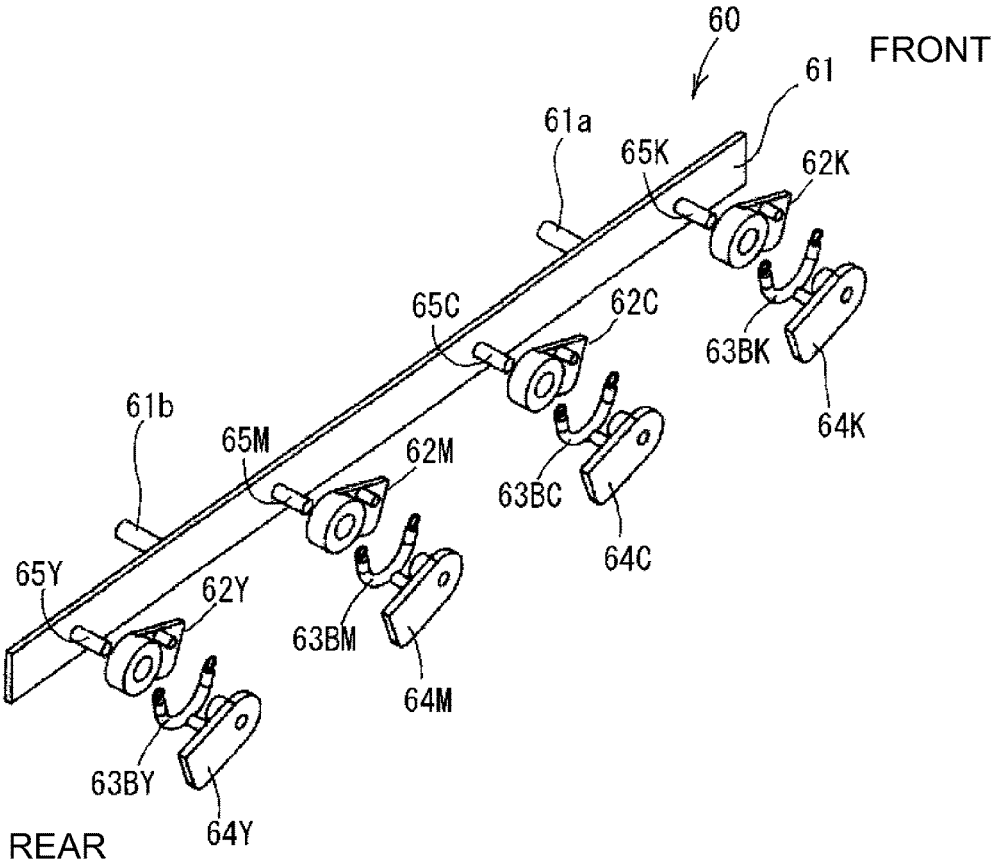

FIG. 18 is an exploded perspective view of the pressing mechanism in the fourth embodiment of the present invention.

Figure 19:
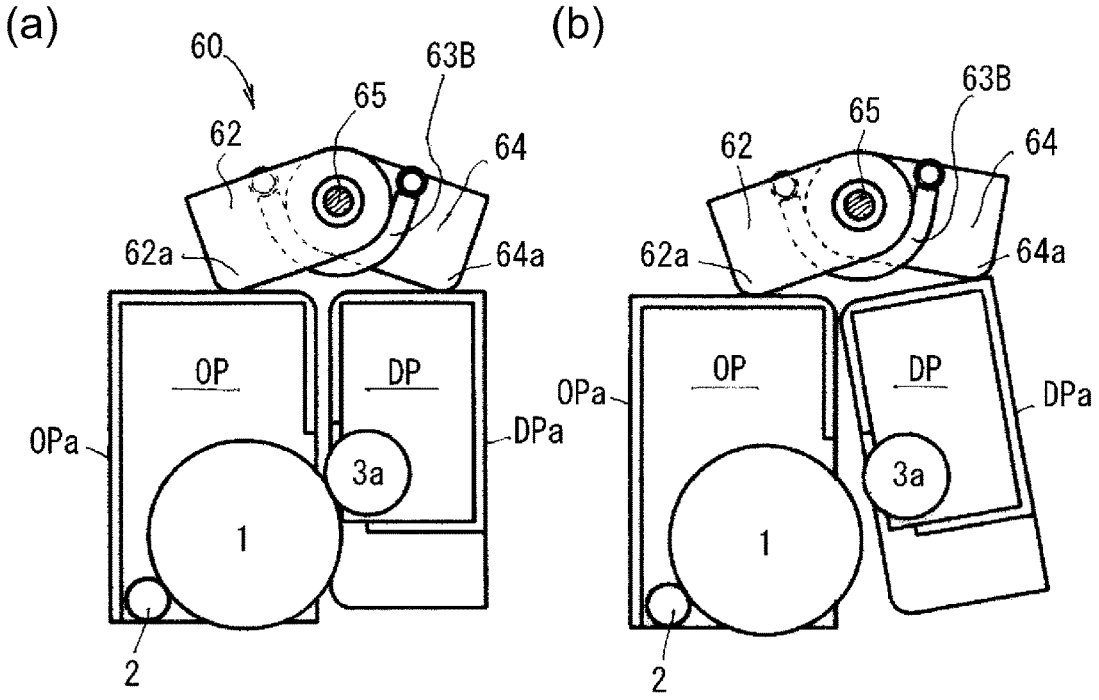

Parts (a) and (b) of FIG. 19 are schematic views illustrating the operation of the pressing mechanism, which occurs when the development cartridge is placed in contact with the drum cartridge, and which occurs when the development cartridge is separated from the drum cartridge, respectively.

DESCRIPTION OF THE EMBODIMENTS

Embodiment 1

<Image Forming Portion>

Referring to FIGS. 4 and 5, the image forming portion of the image forming apparatus 100 in this embodiment is described about its general structure.

FIG. 4 is an external perspective (schematic) view of the image forming apparatus 100. FIG. 5 is a (schematic) vertical sectional view of the image forming apparatus 100 shown in FIG. 4, as seen from the left-hand side of the apparatus. This image forming apparatus 100 uses an electrophotographic process. It is of the so-called inline type (tandem type). It is a full-color printer (electrophotographic image forming apparatus) based on four primary colors.

In the following description of the image forming apparatus 100, the front side of the image forming apparatus 100 (side which faces user) is the side having the front door 31, which can be pivotally opened or closed. The rear side (opposite side from user) is the opposite side from the front side. The front-rear direction includes the rear-to-front direction of the image forming apparatus 100 as well as the front-to-rear direction. The left and right of the image forming apparatus 100 are the left and right of the apparatus 100 as seen from the front side of the apparatus 100. The left-right direction includes the right-to-left direction (leftward direction) as well as the opposite direction (rightward direction) from the right-to-left direction. The top and bottom sides (directions) are the top and bottom sides with reference to the gravity direction. The upward direction is the bottom-to-top direction. The downward direction is the top-to-bottom direction.

Further, the lengthwise direction is the direction which is parallel to the rotational axis of the electrophotographic photosensitive member 1 (or generatrix of photosensitive member 1) which is a rotatable image bearing member (rotational member), which is in the form of a drum, and on which a latent image is formed. The widthwise direction is the direction which is perpendicular to the lengthwise direction (perpendicular direction). Further, one of the lengthwise ends of the photosensitive member 1 is referred to as the drive side, whereas the other end is referred to as the non-drive side. In this embodiment, the right end of the apparatus 100 (photosensitive member 1) corresponds to the drive side, and the lengthwise left end corresponds to the non-drive side.

This image forming apparatus 100 employs multiple cartridges, more specifically, four (first to fourth) drum cartridges OP (Y, M, C and K), and four development cartridges OP (Y, M, C and K), which correspond to the four drum cartridges OP (Y, M, C and K), respectively. The image forming apparatus 100 can form a full-color image (based on four primary colors) or a monochromatic image on a sheet of recording medium S, in response to electrical image formation signals which are outputted from an external host apparatus 400, and are inputted into its control portion 200 through its interface portion 300.

The external host apparatus 400 is a personal computer, an image reader, a facsimile apparatus (from which image formation signals are sent), or the like. A sheet of recording medium S is a sheet of recording medium (which may be referred to simply as a recording medium) on which an image can be formed of toner. Hereafter, an image formed of toner will be referred to as a toner image. As recording media, ordinary paper, cardstock, OHP film, coated paper, label paper, and the like can be listed.

The control portion 200 is a controlling means for controlling the image formation process of the image forming apparatus 100. It exchanges various electrical information with the external host apparatus 400. Further, it is in charge of the operation to process the electrical information inputted from various processing devices, and sensors, process the command signals to be sent to the various processing devices, control the preset initialization sequence, control the preset electrophotographic image formation process sequence, and the like.

In the apparatus main assembly 100A, there are the aforementioned four drum cartridges OP (Y, M, C and K) and four development cartridges DP (Y, M, C and K), which are held by a cartridge tray 250, being thereby held in preset positions, one for one. The apparatus main assembly 100A is what remains after the removal of the drum cartridges OP and development cartridges DP, or a process cartridge PP (embodiment 2) which integrally holds a drum cartridge OP and a development cartridge DP, from the image forming apparatus 100.

The installation position for the drum cartridge OP, and that for the development cartridge DP, are such positions that are in the apparatus main assembly 100A and enable the drum cartridge OP and development cartridge DP to perform an image forming operation. The drum cartridge OP and development cartridge DP contribute to an image formation process for forming an image on a sheet of recording medium S. They are removably installable in the apparatus main assembly 100A to be used.

Each of the various drum cartridges OP in this embodiment has: an electrophotographic photosensitive member (photosensitive drum, which hereafter may be referred to simply as drum), which is in the form of a drum; and a charge roller 2 (charging means) as electrophotographic processing means for processing the drum 1.

Each of the development cartridges DP in this embodiment is a unit (developing device) which has a development roller 3*a*, and a developer storage portion 3*b*, etc. The development roller 3*a* is a developer bearing member (developing member) which supplies the drum 1 of the corresponding drum cartridge OP with developer to develop a latent image formed on the drum 1, into a visible image, that is, an image formed of developer, which hereafter may be referred to as a developer image.

There are two types of development process through which a latent image on the drum 1 is developed by the development cartridge DP. One is referred to as the contact type, and the other is referred to as the non-contact type. In the case of the contact type, the developer bearing surface of the development roller 3*a* is placed in contact with the drum 1 to develop the latent image on the drum 1. In the case of the non-contact type, the developer bearing surface of the development roller 3*a* is not placed in contact with the drum 1. More specifically, the lengthwise end portions of the development roller 3*a* are fitted with a pair of spacer rollers, one for one, which are placed in contact with the drum 1, providing a preset amount of gap between the development bearing surface of the development roller 3*a* and the drum 1. Thus, the developer borne on the development roller 3*a* is made to jump from the development roller 3*a* onto the drum 1 through this minute gap to develop the latent image.

This invention relates to both an image forming apparatus configured so that the development roller 3*a*, which is a developing member for developing the latent image on the drum 1, is placed in contact with the drum 1, as well as an image forming apparatus configured so that the development roller 3*a* is not placed in contact with the drum 1 to develop the latent image on the drum 1.

The four development cartridges DP are different in the color of the developer (which hereafter may be referred to as toner) stored therein. That is, the first development cartridge DPY stores yellow (Y) toner in its developer storage portion 3*b*. It forms a yellow (Y) image on the peripheral surface of the drum 1 of the first drum cartridge OPY. The second developer cartridge DPM stores magenta (M) toner in its developer storage portion 3*b*. It forms a magenta (M) toner image on the peripheral surface of the second drum cartridge OPM.

The third development cartridge DPC stores cyan (C) toner in its developer storage portion 3*b*. It forms a cyan (C) image on the peripheral surface of the drum 1 of the third drum cartridge OPC. The fourth developer cartridge DPK stores black (K) toner in its developer storage portion 3*b*. It forms a black (K) toner image on the peripheral surface of the fourth drum cartridge OPK.

The image forming apparatus 100 is provided with a scanner unit 11 as an exposing apparatus unit (exposing means) for exposing the peripheral surface of the drum 1 of each cartridge to form a latent image. The scanner unit 11 is positioned so that it covers the top side of the drum 1 of each drum cartridge OP. Further, the apparatus 100 is provided with an intermediary transfer unit 12 (structure related ITB system), which is positioned so that it opposes each drum cartridge OP from the bottom side of the cartridge OP. The intermediary transfer unit 12 opposes the drum 1 of each drum cartridge OP. It is such a unit (transferring member) that transfers (primary transfer) a toner image from the drum 1 of each drum cartridge OP onto its transferring member, and then, transfers (secondary transfer) the toner image from the transferring member onto a sheet of recording medium S.

The intermediary transfer unit 12 has a flexible endless belt 13 (ITB, which hereafter is referred to simply as a belt) as an intermediary transferring member (secondary image bearing member: intermediary recording medium). Further, it has a combination of three rollers, more specifically, a driving roller 14, an auxiliary roller 15, and a tension roller 16, around which the endless belt 13 is supported and tensioned in such a manner that the belt 13 can be circularly driven. The driving roller 14 and auxiliary roller 15 are in the rear side of the interior of the apparatus main assembly 100A. The tension roller 16 is in the front side of the interior of the apparatus main assembly 100A.

Further, each drum cartridge OP is installed in its preset position in the interior of the apparatus main assembly 100A, that is, such a position that when the drum cartridge OP is in this position, the downwardly facing portion of the peripheral surface of each drum 1 remains in contact with the upwardly facing portion of the outward surface of the belt 13. On the inward side of the loop (belt loop) which the belt 13 forms, four primary transfer rollers 17 are disposed so that each opposes the drum 1 of corresponding drum cartridge OP, with the presence of the top portion of the belt 13 between each primary transfer roller 17 and belt 13.

The nip between the drum 1 of each drum cartridge OP and the belt 13 is the primary transfer nip T1.

The secondary transfer roller 27 is in contact with the driving roller 14, with the belt 13 present between the driving roller 14 and secondary transfer roller 27. The interface between the secondary transfer roller 27 and belt 13 is the secondary transfer nip T2. There is disposed on the bottom side of the intermediary transfer unit 12, a feeding unit 18 which can hold multiple sheets of recording medium S, onto which a toner image is transferred, and feeds sheets of recording medium S, one by one, into the apparatus main assembly 100A and conveys each sheet to the secondary transfer nip T2 of the belt 13. This feeding unit 18 has: a feeder tray 19 in which sheets of recording medium S are stored in layers; a feed roller 20; a separation pad 21; and a pair of registration rollers 22. The feeder tray 19 can be inserted into the apparatus main assembly 100A from the front side of the image forming apparatus 100 (front loading).

There is disposed in the top-rear portion of the interior of the apparatus main assembly 100A, a fixing apparatus 23 and a pair of discharge rollers 24. The fixing apparatus 23 is such a unit (fixing means) that applies heat and pressure to a sheet of recording medium S, onto which an unfixed toner image has just been transferred in the secondary transfer nip T2, to fix the unfixed toner image to the sheet. The fixing apparatus 23 has a fixation film assembly 23*a* and a pressure roller 23*b*. The pair of discharge rollers 24 are discharge rollers 24*a* and 24*b*. Further, a part of the top surface of the apparatus main assembly 100A is utilized as a delivery tray 25.

The image forming apparatus 100 is provided with a front door 31 (member which can be opened or closed), which is attached to the front side of the apparatus main assembly 100A so that it can be pivotally moved to be opened or closed relative to the apparatus main assembly 100A. The front wall of the apparatus main assembly 100A is provided with an opening 100B, through which the interior of the apparatus main assembly 100A can be accessed. The front door 31 is manually movable between a closed position in which it keeps the opening 100B closed as shown in FIGS. 4 and 5, and an open position in which it keeps the opening 100B completely exposed as shown in part (b) of FIGS. 8, 9(*b*) and 10(*b*). A referential code 31*a* stands for a handhold for opening or closing the front door 31.

The operation to exchange the drum cartridges OP and development cartridges DP in the apparatus main assembly 100A involves opening and closing of the front door 31. These operations will be described later.

<Description of Image Forming Operation>

Next, referring to FIG. 5, the operation to form a full-color image is described. The apparatus main assembly 100A is provided with mechanisms 70-73 (which hereafter will be referred to as moving mechanisms) for moving each development cartridge DP to its first position in which the development roller 3*a* of the development cartridge DP remains in contact with the drum 1 of the corresponding drum cartridge OP, or to its second position in which the development roller 3*a* remains separated from the drum 1 by a preset distance. These moving mechanisms 70-73 will be described later.

The above-mentioned first position for the development cartridge DP is such a position (development position) that makes it possible for the development roller 3*a* to develop the latent image on the drum 1. By the way, the present invention is compatible with both a developing means of the so-called contact type, and a developing means of the so-called non-contact type. The movement of the development cartridge DP into the first position will be referred to as developmental contact (contacting operation). The second position for the development cartridge DP is such a position that does not allow the development cartridge DP to develop the latent image on the drum 1. The movement of the development cartridge DP into the second position is referred to as developmental separation.

The moving mechanisms 70-73 are under the control of the control portion 200. When the image forming apparatus 100 is on standby, more specifically, when the image forming apparatus 100 is waiting for the inputting of a printing job, the control portion 200 keeps all the development cartridges DP in the state of developmental separation, that is, the state in which the development cartridges DP are kept separated from the corresponding drum cartridges OP by the moving mechanisms 70-73. As the control portion 200 receives the signals for the formation of a full-color printing job, from the external host apparatus 400, it controls the moving mechanisms 70-73 to change the development cartridges DP in state from the state of developmental separation (one in which the development roller 3*a* of each development cartridge DP remains separated from the drum 1 of the corresponding development cartridge DP), into the state of developmental contact (one in which the development roller 3*a* remains in contact with the drum 1).

Further, the control portion 200 rotationally drives the drum 1 of each drum cartridge OP in the counterclockwise direction indicated by an arrow mark in FIG. 5 at a preset speed, and also, circularly drives the belt 13 in the clockwise direction indicated by another arrow mark in FIG. 5 at a speed which corresponds to the speed of the drum 1. In synchronism with this rotational driving of the drum 1 and belt 13, the control portion 200 uniformly charges the peripheral surface of the drum 1 of each drum cartridge OP to preset polarity and potential level with the use of the charge roller 2 with preset control timing. Further, the control portion 200 drives each development cartridge DP (rotational driving of development roller 3*a*, application of development bias, stirring toner, etc.)

Further, the control portion 200 drives the scanner unit 11 with preset control timing to expose the peripheral surface of the drum 1 of each drum cartridge OP; it makes the scanner unit 11 project a beam of light in response to image formation signals which are related to the primary colors of the image to be formed. Consequently, electrostatic latent images, which correspond to four primary colors of the image to be formed, are effected on the peripheral surfaces of the drums 1, one for one. Each of the effected latent images is developed by the development roller 3*a* of the corresponding development cartridge DP, into a visible image (image formed of toner, or toner image).

Through an electrophotographic image formation process such as the one described above, a yellow (Y) toner image, which corresponds to the yellow (Y) component of the full-color image to be formed, is formed on the peripheral surface of the drum 1 of the first drum cartridge OPY. This toner image is transferred (primary transfer) onto the belt 13 in the primary transfer nip T1 between the drum cartridge OPY and belt 13.

On the drum 1 of the second drum cartridge OPM, a magenta (M) toner image, which corresponds to the magenta (M) component of the full-color image, is formed on the peripheral surface of the drum 1 of the second drum cartridge OPM. This toner image is transferred (primary transfer) onto the belt 13 in the primary transfer nip T1 between the drum cartridge OPM and belt 13, in a manner to be layered upon the yellow (Y) toner image which has just been transferred onto the belt 13.

On the drum 1 of the third drum cartridge OPC, a cyan (C) toner image, which corresponds to the cyan (C) component of the full-color image, is formed on the peripheral surface of the drum 1 of the third drum cartridge OPC. This toner image is transferred (primary transfer) onto the belt 13 in the primary transfer nip T1 between the drum cartridge OPC and belt 13, in a manner to be layered upon the combination of yellow (Y) and magenta (M) toner images which are on the belt 13.

On the drum 1 of the fourth drum cartridge OPK, a black (K) toner image, which corresponds to the black (K) component of the full-color image, is formed on the peripheral surface of the drum 1 of the fourth drum cartridge OPK. This toner image is transferred (primary transfer) onto the belt 13 in the primary transfer nip T1 between the drum cartridge OPK and belt 13, in a manner to be layered upon the yellow (Y), magenta (M), and cyan (C) toner images which have just been transferred onto the belt 13.

As a result, an unfixed full-color toner image is synthetically formed of the yellow (Y), magenta (M), cyan (C) and black (K) toner images, on the belt 13.

Meanwhile, the feed roller 20 begins to be driven with preset control timing. Thus, the sheets of recording medium S stored in layers in the feeder tray 19 are fed one by one into the apparatus main assembly 100B, while being separated from the rest, by the coordination between the feed roller 20 and separation pad 21. Then, each sheet of recording medium S is delivered to the secondary transfer nip T2 by the pair of registration rollers 20 with preset control timing, and is introduced into the secondary transfer nip T2. Then, the sheet S is conveyed through the secondary transfer nip T2 remaining pinched by the nip T2. While the sheet S is conveyed through the secondary transfer nip T2, remaining pinched by the secondary transfer nip T2, the four toner images, which are different in color and layered on the belt 13, are transferred together onto the sheet of recording medium S as if they are peeled away from the belt 13.

Then, the sheet of recording medium S is separated from the surface of the belt 13, and is introduced into a fixing apparatus 23 through a sheet conveyance passage. In the fixing apparatus 23, the sheet of recording medium S and the toner images thereon are heated and pressed in the fixation nip Q. Consequently, the four monochromatic toner images, different in color, on the sheet S are fixed to the sheet S while being mixed. Thereafter, the sheet is conveyed out of the fixing apparatus 23, and is discharged onto the delivery tray 25 by the pair of discharge rollers 24. The secondary transfer residual toner, which is the toner remaining on the outward surface (with reference to belt loop) after the secondary transfer, is removed by a cleaning means 26.

As the inputted printing job ends, the control portion 200 stops the image forming operation of the image forming apparatus 100, and puts the apparatus 100 on standby. More concretely, the control portion 200 controls the moving mechanisms 70-73 so that all the development cartridges DP are changed in state from the state of developmental contact to the state of developmental separation. Then, the control portion 200 keeps all the development cartridges DP in the state of developmental separation.

In the case of a printing job for forming a monochromatic image, the control portion 200 changes only the development cartridge DPK which corresponds to the drum cartridge OPK for forming a black toner image, in state from the state of developmental contact to the state of developmental separation. Other development cartridges DPY, DPM and DPC which correspond to the drum cartridges OPY, OPM and OPC, respectively, are kept in the state of developmental separation.

With the image forming apparatus 100 being in the state described above, the control portion 200 makes the combination of the drum cartridge OPK for forming a black toner image, and development cartridge DP which corresponds to the drum cartridge OPK, perform an image forming operation to form a monochromatic (black-and-white) image, while letting the drums 1 of the other drum cartridges OPY, OPM and OPC idle. As soon as the control portion 200 finishes the inputted printing job, it ends the image forming operation of the image forming apparatus 100, and puts the apparatus 100 on standby. During this process, the control portion 200 controls the moving mechanisms 72 and 73 to change the development cartridge DPK which corresponds to the drum cartridge OPK, in state from the state of developmental contact to the state of developmental separation. Then, it keeps the development cartridge DPY in this state.

<Cartridge Structure>

Next, referring to parts (a)-(d) of FIG. 6, the drum cartridge OP and development cartridge DP are described about their structure. Part (a) of FIG. 6 is a perspective view (schematic view) of the drum cartridge OP as seen from the drive side. Part (b) of FIG. 6 is a sectional view (schematic view) of the drum cartridge OP. Part (c) of FIG. 6 is a perspective view (schematic view) of the development cartridge DP as seen from the drive side. Part (d) of FIG. 6 is a sectional view (schematic view) of the development cartridge DP.

The drum cartridge OP comprises the drum 1, charge roller 2, and a casing OPa in which the drum 1 and charge roller 2 are held. More concretely, the drum 1 is rotatably held between the side plates of the drive and non-drive sides of the casing OPa, with the placement of the drum flanges 1*a*R and 1*b*L (unshown) between the drum 1 and side plates. The drive side flange 1*a*R is provided with a drum coupling 1*c*, through which driving force is inputted into the drum 1 from the apparatus main assembly 100A. The charge roller 2 is rotatably held between the side plates on the drive and non-drive sides, with the presence of charge roller flange (unshown) between the charge roller 2 and side plates.

The casing OPa of the drum cartridge OP is provided with a pair of O bosses 1*b*R and 1*b*L (unshown) for fixing the drum cartridge OP in attitude when the drum cartridge OP is installed into the cartridge tray 250. The pair of O bosses 1*b*R and 1*b*L perpendicularly protrude outward from the side plates of the casing OPa, respectively.

The development cartridge DP has a casing DPa. It has also a development roller 3*a* and developer storage portion 3*a*, which are in the casing DPa. The development roller 3*a* is rotatably held by the development roller flanges 3*aR* and 3*aL* (unshown), between the side plate of the drive side and the side plate of the non-drive side. The development roller flange 3*a*4 on the drive side is provided with a development coupling 3*c* for inputting driving force into the development roller 3*a* from the apparatus main assembly 100A. As rotational driving force is inputted into the development coupling 3*c*, it is transmitted to the development roller 3*a* through a gear train (unshown), and rotationally drives the development roller 3*a*.

<Relationship Between Cartridge and Cartridge Tray>

Next, referring to parts (a) and (b) of FIG. 7, the states of the cartridge tray 250, drum cartridges OP, and development cartridges DP, in which the drum cartridges OP and development cartridges DP are in their preset position in the cartridge tray 250, are described. Part (a) of FIG. 7 is a side view (schematic view) of a combination of the drum cartridges OP and development cartridges DP after the installation of the cartridges into the cartridge tray 250. Part (b) of FIG. 7 is a perspective view (schematic view) of the combination of the drum cartridges OP and development cartridges DP, as seen from the bottom side of the cartridge tray 250, after the installation of the cartridges OP and DP into the cartridge tray 250.

The drum cartridges OP for yellow (Y), magenta (M), cyan (C) and black (K) colors, one for one, are basically the same in the state in which they are in after their installation into the cartridge tray 250. Here, therefore, only the installation of the drum cartridge OPK for black (K) color, and that of the development cartridge DPK for black (K) color, are described.

After the installation of the drum cartridge OPK into the cartridge tray 250, the drum flange 1*a*R_K is in engagement with the engaging portion 250*e*R_K of the cartridge tray 250, and the O boss 1*b*R_K is in engagement with the engaging portion 250*a*R_K of the cartridge tray 250. After the installation of the development cartridge DPK into the cartridge tray 250, the development roller flange 3*a*R_K is in engagement with the engaging portion 250*f*R_K of the cartridge tray 250.

When the drum cartridge OPK, development cartridge DPK, and cartridge tray 250 are in the state described in the preceding paragraph, the drum flange 1*a*R_K and O boss 1*b*R_K of the drum cartridge OPK are the portions of the drum cartridge OPK, by which the drum cartridge OPK is positioned relative to the cartridge tray 250, and the engaging portions 250*e*R_K and 250*a*R_K are the drum cartridge positioning portions of the apparatus main assembly 100A. Further, the development roller flange 3*a*R_K of the development cartridge DPK is the portion of the development cartridge DPK, by which the development cartridge DPK is positioned relative to the cartridge tray 250. Further, the engaging portion 250*f*R_K of the cartridge tray 250 is the portion of the cartridge tray 250, which positions the development cartridge DPK relative to the cartridge tray 250.

Although the above description regards only the drive side of the cartridge, the description of the non-drive side of the cartridge is basically the same. That is, the non-drive side of the drum cartridge OPK and that of the development cartridge DPK also have the drum flange 1*aL*_K, O boss 1*bL*_K, and development roller flange 3*aL*_K (none is shown), respectively.

As the drum cartridge OPK is installed into the cartridge tray 250, the drum flange and O boss of the drum cartridge OPK, which are on the drive and non-drive sides, respectively, engage with the engaging portions of the cartridge tray 250, on the drive and non-drive sides, respectively, whereby the drum cartridge OPK is fixed in attitude relative to the cartridge tray 250. Further, the development roller flanges of the development cartridge DPK on the drive and non-drive sides, respectively, engage with the engaging portions of the cartridge tray 250, on the drive and non-drive sides, respectively, whereby the development cartridge DPK is supported by the cartridge tray 250 in such a manner that it is rotatable about the development roller flange. That is, the development cartridge DPK is supported by the cartridge tray 250 in such a manner that it is rotatable about the development coupling 3*c*.

<Cartridge Insertion and Extraction>

As the developer in a cartridge purchased by a user is consumed to such a degree that the cartridge cannot form an image which is satisfactory in quality to the user, the cartridge loses its commercial value. Thus, the image forming apparatus 100 and cartridges therefor are provided with a means (unshown) for detecting the amount of developer remaining in each cartridge. The control portion 200 compares the detected amount of developer in the cartridge with a threshold value preset to predict the length of remaining life span of the cartridge. If the control portion 200 determines that the remaining amount of developer in any cartridge is less than the threshold value, it gives information (warning) about the predicted length of the remaining life of the cartridge, on the display of the image forming apparatus 100, to prompt a user to replace the cartridge.

Each cartridge is replaceable through the following procedure: First, a user is to open the front door 31 of the main assembly 100A of the image forming apparatus 100. That is, the user is to pivotally move the front door 31 from the closed position to the open position. As the front door 31 is opened, the front opening 100B of the apparatus main assembly 100A is fully exposed. At the same time, the cartridge tray 250, which kept the drum cartridges OP and development cartridges DP in the image forming positions, is moved by the rotational opening movement of the front door 31, into a position which is inside the apparatus main assembly 100B, and from which it can be pulled out of the apparatus main assembly 100B. This movement of the cartridge tray 250 is described later.

The user is to pull the cartridge tray 250 (which hereafter may be referred to simply as tray) which is in the position from which the tray 250 can be pulled out of the apparatus main assembly 100B, through the opening 100B, so that the tray 250 is moved into a preset position which is outside the apparatus main assembly 100A. When the tray 250 is in the position from which it can be pulled out of the apparatus main assembly 100A, it can be moved from the position in the apparatus main assembly 100A, to a position which is a preset outside position, along a pair of horizontal guides of the apparatus main assembly 100A, which are on the drive and non-drive sides, one for one. A referential code 250*t* stands for a handhold, with which the front portion of the frame of the tray 250 is provided to facilitate the operation to pull the tray 250 out of the apparatus main assembly 100A, or push the tray 250 back into the apparatus main assembly 100A.

As the tray 250 is moved into its preset outside position, it becomes possible for each of the drum cartridges OP and each of the development cartridges DP to be installed into, or uninstalled from, the tray 250; it becomes possible for each of the drum cartridges OP and each of the development cartridges DP in the tray 250 to be replaced. Then, the user is to push the tray 250 back into the aforementioned position which is in the apparatus main assembly 100A, and from which the tray 250 can be pulled out of the apparatus main assembly 100A, and then, to move the front door 31 into the closed position A. As the front door 31 is pivotally closed, the tray 250 is moved by the pivotal movement of the front door 31, from the position from which the tray 250 can be pulled out of the apparatus main assembly 100A, to the position in which the tray 250 keeps each of the drum cartridges OP and each of the development cartridges DP in the preset position (image formation position) in the apparatus main assembly 100A.

Referring to FIG. 5, the process through which a cartridge which is in the position (image formation position) in the apparatus main assembly 100A by being supported by the tray 250, is moved into the position which is outside the apparatus main assembly 100A, and makes it possible for the cartridge to be replaced, is described.

Each drum cartridge OP and each development cartridge DP are held by the tray 250. In order to make it possible to move the tray 250 from the image formation position in the apparatus main assembly 100A to the position which is outside the apparatus main assembly 100A, it is necessary to move the tray 250 upward to separate the tray 250 from the intermediary transfer unit 12, and then, to move the tray 250 frontward.

Next, referring to FIGS. 8-11, the above described movements of the tray 250 are described. Part (a) of FIGS. 8, 9, 10 and 11 are drawings of the portions of the image forming apparatus 100, which are related to the present invention, when the front door 31 is remaining closed. Part (b) of FIGS. 8, 9, 10 and 11 are drawings of the portions of the image forming apparatus 100, which are related to present invention, when the front door 31 is open.

The hinges 31*a*L and 31*a*R of the front door 31 are rotatably supported by the apparatus main assembly 100A. Further, the bosses 40*b*L and 40*b*R of the link 40L and 40R of the front door 31, are fitted in the holes 31*b*L and 31*b*R of the front door 31, being thereby supported by the front door 31 in such a manner that the bosses 40*b*L and 40*b*R are allowed to move along the long edges of the holes 31*b*L and 31*b*R, while being allowed to rotate relative to the links 40L and 40R, respectively. The front door link hinges 40*a*L and 40*a*R are rotatably supported by the apparatus main assembly 100A (unshown). The description of this embodiment, which is given hereafter is related to only the drive side of the apparatus 100. The description of the non-drive side is virtually the same as that of the drive side.

The boss 40*c*R of the front door link 40R is fitted in the hole 41*a*R of the slide link 41R so that it is allowed to move in the direction parallel to the lengthwise direction of the hole 41*a*R, while being allowed to rotate in the hole 41*a*R. The slide link 41R is held by the right side plate 50R fixed to the apparatus main assembly 100A, in such a manner that it is allowed to move in the front-rear direction (holding structure is unshown). Further, the bosses 42*a*R and 42*b*R of the slide cam 42R are fitted in the slide link holes 41*b*R and 41*c*R, respectively, in such a manner that they are allowed to move in the vertical direction (FIGS. 8 and 9). Further, they are also supported by the horizontal surface and slanted surface of the right side plate hole 50*a*R and 50*b*R (parts (a) and (b) of FIG. 10).

As the closed front door 31 (part (a) of FIG. 8) is opened (part (b) of FIG. 8), the front door link 40R is rotationally moved by the pivotal movement of the front door 31, about the front door link hinge 40*aR*. Consequently, the boss 40*bR* of the front door link 40R rotates frontward. Thus, the slide link 41R moves frontward.

As the slide link 41R moves frontward, the slide cam 42R, which is in engagement with the slide link 41R, also moves frontward. However, the slide cam 42R is in engagement with the right side plate 50R. Therefore, the bosses 42*aR* and 42*bR* of the slide cam 42R move upward along the slanted surface of the right side plate holes 50*aR* and 50*bR*. In other words, the slide cam 42R moves upward while moving frontward (parts (a) and (b) of FIG. 10).

Referring to part (a) of FIG. 11, when the front door 31 is remaining closed, the tray 250 is in engagement with the intermediary transfer unit 12. When the front door 31 is in this state, the surface 42*e*R of the slide cam 42R is not in contact with the cartridge rail 250*g*R.

As the front door 31, which is remaining closed, is opened, the slide cam 42R moves upward as described above. Thus, the surface 42*c*R of the slide cam 42R comes into contact with the cartridge rail 250*g*R, as shown in part (b) of FIG. 11, and the slide cam 42R moves the tray 250 upward. Consequently, the tray 250 is separated from the intermediary transfer unit 12.

That is, the tray 250, which is supporting each of the drum cartridges OD and each of the development cartridges DP in such a manner that each drum cartridge OD and each development cartridge DP remain in the image formation position, is moved into the position which is in the apparatus main assembly 100A, and from which the tray 250 can be pulled out of the apparatus main assembly 100A. As a result, it becomes possible to move the tray 250 frontward, along the pair of horizontal guiding members (unshown) on the drive and non-drive sides, to pull the tray 250 out of the apparatus main assembly 100A, into the position which is outside the apparatus main assembly 100A, and which makes it possible to exchange one or more of the cartridges in the tray 250.

<Structural Arrangement for Pressing Cartridge>

The drum cartridges OP and development cartridges DP which are in their preset image forming position within the apparatus main assembly 100A, by being held by the tray 250, remain precisely positioned relative to the tray 250, that is, the apparatus main assembly 100A, by being pressed by a pressing mechanism 60. Next, this pressing mechanism 60 is described.

In order to supply the drum 1 in each drum cartridge OP with the toner from the development roller 3*a* of the corresponding development cartridge DP to form a toner image, it is necessary to keep the development roller 3*a* pressed against the drum 1 with a preset amount of force (pressure). Further, it is necessary to prevent each cartridge from being moved by the vibrations or the like to prevent the drum 1, etc., from being scarred while the apparatus main assembly 100A is shipped, with the cartridges installed in the main assembly 100A. That is, it is necessary for the cartridges to be kept pressed in order to prevent the cartridges from moving, even when the development roller 3*a* of the development cartridge DP is kept separated from the drum 1 of the drum cartridge OP.

Figure 2:
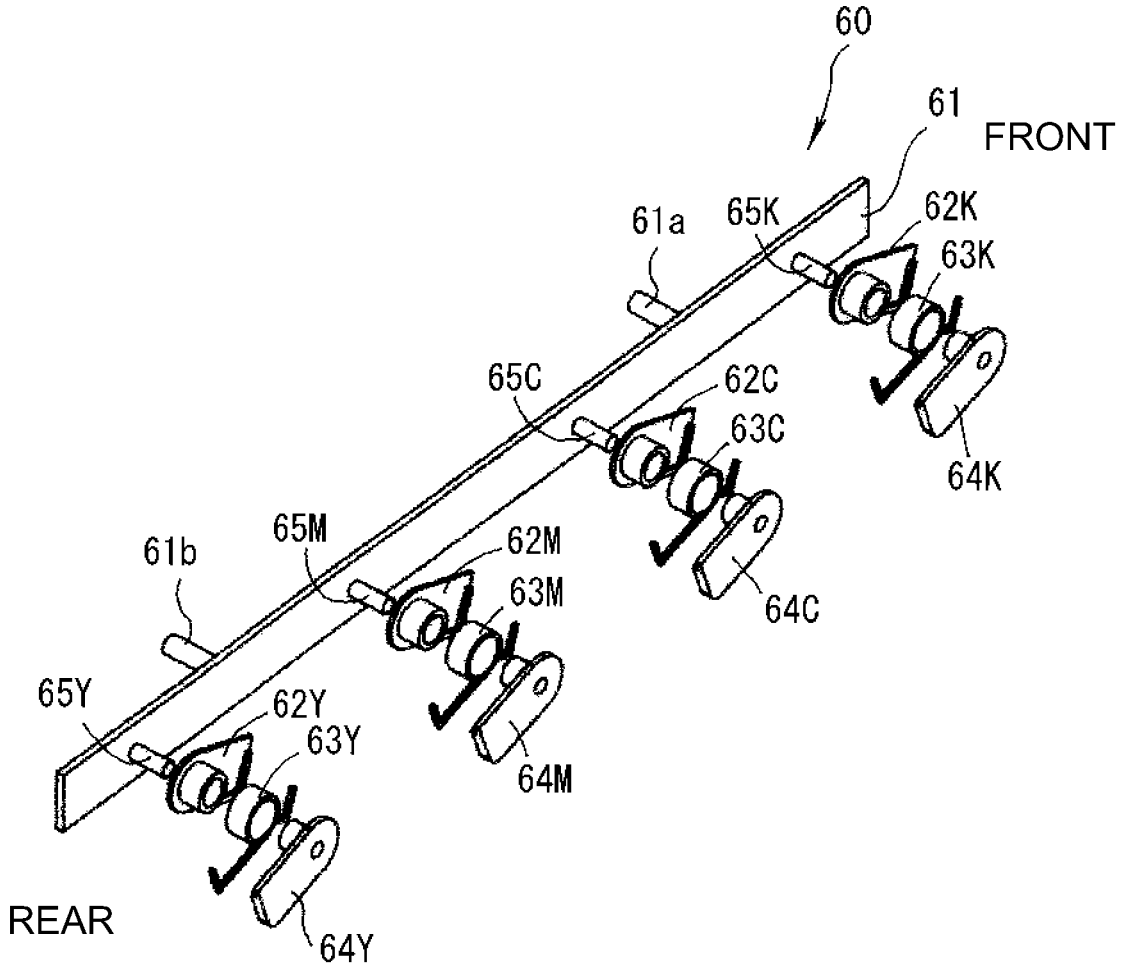
FIG. 2 is an exploded perspective view of the pressing mechanism.

FIG. 2 is an exploded perspective view (schematic view) of the pressing mechanism 60, in this embodiment, for keeping the development cartridges DP pressed upon the corresponding drum cartridges OP, one for one. The apparatus main assembly 100A is provided with a pair of pressing mechanisms 60, which are symmetrically disposed on the drive and non-drive sides, in the apparatus main assembly 100A. The following description of the pressing mechanism 60 concerns only the drive side. However, the description of the non-drive side is basically the same as that of the drive side.

The pressing mechanism 60 in this embodiment comprises:

1) Single torsional coil spring 63 (Y M, C and K) as an elastic member,

2) First pressing member 62 (Y, M, C and K) having the first pressing portion 62*a* (parts (a)-(d) of FIG. 3) which transmits the force from the torsional coil spring 63 to the drum cartridge OP, 3) Second pressing member 64 (Y, M, C and K) having the second pressing portion 64*a* (parts (a)-(d) of FIG. 3) which transmits the force from the torsional coil spring 63 to the development cartridge DP, and 4) Pressure stay 61 which holds these members 62, 63, 64 with a single rotational shaft 65 (Y, M, C and K) per combination of a drum cartridge OP and the corresponding development cartridge DP.

Referring to parts (a)-(d) of FIG. 3, the first pressing portion 62*a* of the first pressing member 62 presses the top surface of the casing OPa of the drum cartridge OP, by the force received from the torsional coil spring 63. Thus, the drive side drum flange 1*a*R and O boss 1*b*R of the drum cartridge OP are pressed by the corresponding engaging portions 250*e*R and 250*e*L of the tray 250. That is, the drum cartridge OP is positioned by being pressed on the tray 250 (apparatus main assembly 100A).

Further the first pressing portion 62*a* of the second pressing member 62 presses on the top surface of the casing DPa of the development cartridge DP, by the force it receives from the torsional coil spring 63. Thus, the drive side development roller flange 3*a*R of the development cartridge DP is pressed by the corresponding engaging portion 250*f*R of the tray 250. That is, the development cartridge DP is positioned by being pressed on the tray 250 (apparatus main assembly 100A).

On the other hand, from the standpoint of usability, the pressing mechanism 60 has to be structured so that the pressure is easily removable in order to prevent the pressure from interfering with the installation or uninstallation of the cartridges. Next, referring to FIGS. 9-11, and 2, the operation of the pressing mechanism is described. As described above, as the front door 31 is opened (part (b) of FIG. 9) from the position where it is remaining closed (part (a) of FIG. 9), the front door link 40R is rotated by the pivotal movement of the front door 31 about the front door link hinge 40*aR*. Thus, the boss 40*bR* of the front door link 40R rotates frontward. Therefore, the slide link 41R moves frontward.

Referring to FIGS. 8 and 9, the front and rear bosses 61*a* and 61*b* of the pressure stay 61, are held by the horizontal surface and slanted surface of the holes 41*d*R and 41*e*R of the slide link 41R. Further, they are fitted in the holes 50*c*R and 50*d*R of the right side plate in such a manner that they are allowed to move in the vertical direction. Therefore, as the slide link 41R moves frontward, the pressure stay bosses 61*a* and 61*b*, which are in engagement with the slide link 41R, also move frontward. However, the pressure stay 61 is in engagement with the right side plate as well. Therefore, the pressure stay bosses 61*a* and 61*b* climb the slanted surfaces of the holes 41*d*R and 41*e*R of the slide link 41R. Thus, the pressure stay 61 moves upward (parts (a) and (b) of FIG. 10).

That is, the pressing mechanism 60 retracts upward from the top surface of each drum cartridge OP in the tray 250, and that of each development cartridge DP in the tray 250.

Referring to part (a) of FIG. 11, when the front door 31 is remaining closed, the first and second pressing members 62 and 64, respectively, of the pressing mechanism 60 are in contact with the top surface of the casing OPa of each drum cartridge OP, and the top surface of the casing DPa of each development cartridge DP, respectively (part (a) of FIGS. 3 and 3(*b*)).

As the front door 31 is opened while it and the pressing mechanism 60 are in the above described states, the pressing mechanism 60 retracts upward as described above. Therefore, the pressing mechanism 60 separates from the drum cartridges OP and development cartridges DP (part (b) of FIG. 11). Therefore, the pressure which has been applied to each cartridge by the pressing mechanism 60 is eliminated. Therefore, it becomes possible for the cartridge tray 250 to be pulled out of the apparatus main assembly 100A in the frontward direction.

<Mechanism for Moving Development Cartridge>

As described above, when each drum cartridge OP and corresponding development cartridge DP are in their preset position (image forming position) in the apparatus main assembly 100A, the development roller 3*a* of the development cartridge DP is placed in contact with, or separated from, the drum 1 of the corresponding drum cartridge OP, by the moving mechanisms 70-73 which are under the control of the control portion 200. Next, referring to FIG. 1, the operation of the moving mechanisms 70-73 and that of the pressing mechanism 60, which occur when the development roller 3*a* of the development cartridge DP is placed in contact with the drum 1 of the development cartridge DP, and when the development roller 3*a* is separated from the drum 1, are described. The pressing mechanism 60 is an internal portion of the apparatus main assembly 100A. It comprises the drive and non-drive sides, which are symmetrical with reference to the centerline of the apparatus main assembly 100A. In the following, only the drive side of the pressing mechanism 60 is described. The description of the non-drive side is basically the same as that of the drive side.

In this embodiment, the moving mechanisms 70-73 include the first moving mechanisms 72 and 73 for placing the development roller 3*a* of the fourth development cartridge DP in contact with the drum 1 of the fourth development cartridge DP for forming a black (K) image, or separating the development roller 3*a* from the drum 1. Further, the moving mechanisms 70-73 include the second moving mechanisms 70 and 71 for placing the development roller 3*a* of each of the first to third development cartridges DP (Y, M and C) for forming yellow (Y), magenta (M) and cyan (C) images, with the drum 1 of the corresponding drum cartridge OP (Y, M and C), or separating the development roller 3*a* from the drum 1.

The first moving mechanisms 72 and 73 include a separating member 73 attached to the right side plate 50R to be horizontally movable in the front-rear direction, and a separation cam 72 which acts on the separating member 73. The separating member 73 is under the pressure from a pressing member (unshown), being allowed to move frontward. The separation cam 72 is in contact with the front end surface of the separating member 73, bearing the force from the separating member 73. The separation cam 72 is in connection to a development clutch (unshown) which rotates the separation cam 72 by half a turn (180°), under the control of the control portion 200. The first moving mechanisms 72 and 73 are structured so that the separation cam 72 is enabled to take the first attitude, in which its largest radius portion faces the front end surface of the separating member 73, and the second attitude, in which its smallest radius portion faces the front end surface of the separating member 73.

As the separation cam 72 is rotated into the first attitude, the separating member 73 is moved rearward against the resiliency of the pressing member, and is held in a preset position into which it is rearwardly moved. As the separation cam 72 is rotated into the second attitude, the separating member 73 is moved frontward by the resiliency of the pressing member and is held in a preset frontward position into which it was frontwardly moved.

As the separating member 73 is held in the rearward position, the protrusive portion 73K of the separating member 73 is separated from the fourth development cartridge DPK. Therefore, the development cartridge DPK rotates about the development roller flange 3*a*R(K), into the second position, and is retained in the second position. That is, the development cartridge DPK is held in the state in which its development roller 3*a* remains separated from the drum 1 of the corresponding drum cartridge OP.

Further, as the separating member 73 is held in the frontward position, the protrusive portion 73K of the separating member 73 is separated from the development cartridge DPK. Therefore, the development cartridge DPK rotates about the development roller flange 3*a*R(K), into the first position, and is held in the first position. That is, the development cartridge DPK is held in the state in which its development roller 3*a* is in contact with the drum 1 of the corresponding drum cartridge OP.

The second moving mechanisms 70 and 71 have a separating member 71 attached to the right side plate 50R to be horizontally movable in the front-rear direction, and a separation cam 70 which acts on this separating member 71. The separating member 71 is under the pressure from a pressing member (unshown), being allowed to move frontward. The separation cam 70 is in contact with the front end surface of the separating member 71, bearing the force from the separating member 71. The separation cam 70 is in connection to a development clutch (unshown) which rotates the separation cam 70 by half a turn (180°), under the control of the control portion 200. The second moving mechanisms 70 and 71 are structured so that the separation cam 70 is enabled to take the first attitude, in which its largest radius portion faces the front end surface of the separating member 71, and the second attitude, in which its smallest radius portion faces the front end surface of the separating member 71.

As the separation cam 70 is rotated into the first attitude, the separating member 71 is moved rearward against the resiliency of the pressing member, and is held in a preset position into which it was rearwardly moved. As the separation cam 70 is rotated into the second attitude, the separating member 71 is moved frontward by the resiliency of the pressing member and is held in a preset frontward position into which it was frontwardly moved.

As the separating member 71 is held in the rearward position, the first to third development cartridges DP (Y, M and C) are rotated together by the protrusive portions 71Y, 71M and 71C of the separating member 71, into the second positions, against the pressing force from the second pressing members 64Y, 64M, and 64C, and are held in the second position. That is, the first to third development cartridges DP (Y, M and C) are rotated about the drive side development roller flanges 3*aR* (Y, M and C), into the second position, and are held in the second position. That is, the first to third development cartridges DP (Y, M and C) are rotated about the development roller flanges 3*aR* (Y, M and C), into the second position, in which they are held in the state in which their respective development roller 3*a* remains separated from the corresponding drum 1 of the corresponding drum cartridge OP.

Further, as the separating member 71 is held in the frontward position, the protrusive portions 71Y, 71M, and 71C of the separating member 71 are separated from the development cartridges DPY, DPM and DPK, respectively. Therefore, the development cartridges DPY, DPM and DPC rotate together about the development roller flanges 3*aR* (Y, M and C), into the first position, and are held in the first position, in which they are held in the state in which their development roller 3*a* is in contact with the drum 1 of the corresponding drum cartridge OP. That is, the development cartridge DPK is held in the state of developmental contact (in which its development roller 3*a* is in contact with the drum 1 of the corresponding drum cartridge OP).

Figure 1:
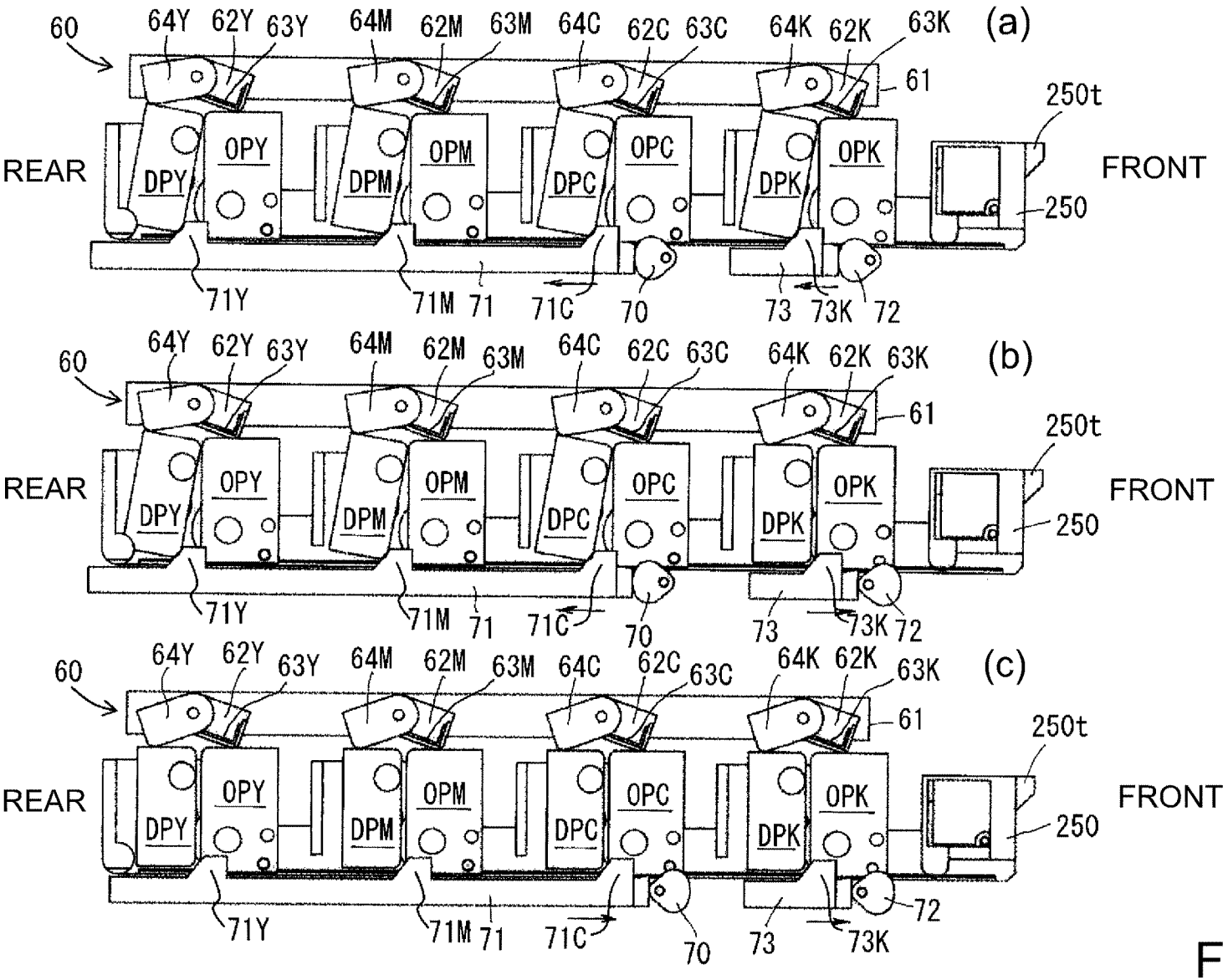

Parts (a), (b) and (c) of FIG. 1 show the state of the portions of the image forming apparatus 100 related to the present invention, when the image forming apparatus 100 is on standby. When the image forming apparatus 100 is on standby, the control portion 200 keeps both the separation cam 72 of the first moving mechanisms 72 and 73, and the separation cam 70 of the second moving mechanisms 70 and 71, in the first attitude. Therefore, all the development cartridges DP (Y, M, C and K), that is, the first to fourth development cartridges DP, are held in the state of developmental separation (in which the development roller 3*a* of each development cartridge DP remains separated from the drum 1 of the corresponding drum cartridge OP).

Part (b) of FIG. 1 shows the state of the portions of the image forming apparatus 100 related to the present invention, immediately after a print job for forming monochromatic (black-and-white) image is inputted. In this case, the control portion 200 changes the separation cam 72 of the first moving mechanisms 72 and 73 in attitude from the first one to the second one, and leaves the separation cam 70 of the second moving mechanisms 70 and 71 in the first attitude.

Thus, the fourth development cartridge DPK which corresponds to the fourth drum cartridge OPK for forming a black (K) image is changed in state from the stat of developmental separation (in which its development roller 3*a* remains separated from the drum 1 of the corresponding drum cartridge OP) to the state of developmental contact (in which the development roller 3*a* is in contact with the drum 1). As for the first to third development cartridges DP (Y, M and C) which correspond to the first to third drum cartridges OP (Y, M and C) for forming yellow (Y), magenta (M), and cyan (C) images, respectively, they all are kept in the state of developmental separation (in which their development roller 3*a* remains separated from the drum 1 of the corresponding drum cartridge OP). With the image forming apparatus 100 remaining in this state, the control portion 200 makes the fourth drum cartridge OPK and fourth development cartridge DPK carry out an image forming operation, and the other drum cartridges OP (Y, M and C) idling, to carry out the inputted job for printing monochromatic (black-and-white) images.

As the control portion 200 finishes the job, it reverses the separation cam 72 of the first moving mechanism 73 in attitude from the second attitude to the first one. Thus, the image forming apparatus 100 goes back into the state of being on standby (part (a) of FIG. 1).

Part (c) of FIG. 1 shows the state of the portions of the image forming apparatus 100 related to the present invention, immediately after a printing job for forming full-color images was inputted. In this case, the control portion 200 changes both the separation cam 72 of the first moving mechanisms 72 and 73, and the separation cam 72 of the second moving mechanisms 72 and 73 in attitude from the first attitude to the second one.

Thus, all of the first to fourth development cartridges DP (Y, M, C and K) are changed in state from the state of developmental separation (in which their development rollers 3*a* remain separated from the drum 1 of the corresponding drum cartridge OP), into the state of developmental contact (in which their development rollers 3*a* are in contact with the drum 1 of the corresponding drum cartridge OP), and are kept in the state of developmental contact. With the image forming apparatus 100 being kept in this state, the control portion 200 makes all of the first to fourth drum cartridges OP (Y, M, C and K) and all of the development cartridges DP (Y, M, C and K) carry out the inputted printing job for forming full-color images.

As the job is finished, the control portion 200 reverses both the separation cam 72 of the first moving mechanisms 72 and 73, and the separation cam 70 of the second moving mechanisms 70 and 71, in attitude from the second attitude to the first one. With this control, the image forming apparatus 100 is put back into the state of being on standby.

Next, referring to part (a) of FIGS. 3 and 3(*b*), the contact between the drum 1 of each drum cartridge OP and the development roller 3*a* of the corresponding development cartridge DP is described.

Here, the relationship between the rotational speed Vd of the development roller 3*a* and the rotational speed Vo of the drum 1 is: Vd>Vo, because toner has to be rubbed onto the drum 1. Therefore, the drum 1 is subjected to the friction Fo from the development roller 3*a*. Further, the drum 1 is given a pressing force Fso from the first pressing member 62 of the pressing mechanism 60, as shown in part (a) of FIG. 3.

Therefore, the drum flange 1*aR*, which is the drive side positioning portion of the drum cartridge OP, and the engaging portion 250*eR* of the tray 250, which is the positioning portion of the apparatus main assembly 100A, are subjected to a combination of forces Fo and Fso, as shown in part (b) of FIG. 3. Thus, it is ensured that the drum cartridge OP (drum 1) is accurately positioned, and remains accurately positioned, relative to the tray 250 (apparatus main assembly 100A).

Next, referring to parts (c) and (d) of FIG. 3, the separation of the development roller 3*a* of each development cartridge DP from the drum 1 of the corresponding drum cartridge OP in the state of developmental separation is described.

When the image forming apparatus 100 is not used for an image forming operation, each development cartridge DP is kept in the state of developmental separation (in which its development roller 3*a* remains separated from the drum 1 of the corresponding drum cartridge OP). Therefore, in a case where the image forming apparatus 100 is shipped (transported) with the cartridges therefor installed in the apparatus main assembly 100A, each development cartridge DP in the apparatus main assembly 100A remains in the state of developmental separation (in which its development roller 3*a* remains separated from the drum 1 of the corresponding drum cartridge OP), for the following reason, until the image forming apparatus 100 is delivered to a user. That is, if the development roller 3*a* always remains in contact with the drum 1, it is possible that the vibrations which occur during the shipment will cause the drum 1 to scar the development roller 3*a*, and/or the development roller 3*a* will be deformed by the contact pressure between the development roller 3*a* and drum 1. With the development roller 3*a* being scarred and/or deformed, it is possible that the image forming apparatus 100 will output unsatisfactory images. This is why the development roller 3*a* is kept separated from the corresponding drum 1 until the image forming apparatus 100 is delivered to a user.

However, the development cartridges DP are kept in the state of developmental separation (development roller 3*a* of development cartridge DP is kept separated from the drum 1 of corresponding drum cartridge OP) by the separation cams, as shown in part (c) of FIG. 3. Therefore, the force for pressing the drum 1 in the direction to position the drum 1 is only the pressing force Fso from the pressing mechanism 60.

In this embodiment, both the drum cartridge OP and development cartridge DP are pressed by the same torsional coil spring 63. Therefore, as the development cartridge DP is moved upward by a distance of 6 mm, the pressing force placed upon the drum cartridge OP increases by 6 Ks (assuming that spring constant of torsional coil spring 63 is Ks).

$$Fso2=Fso+\delta Ks$$

That is, even when the development cartridge DP is in the state of developmental separation, it is ensured that a sufficient amount of force is provided to press on the drum cartridge OP.

To sum up the foregoing, in the case of a conventionally structured image forming apparatus, both the drum cartridge OP and development cartridge DP are provided with their own pressing spring. Thus, when the development roller 3*a* remains separated from the drum 1, the spring pressure reduces by an amount equal to the contact pressure between the drum 1 and development roller 3, making it likely for the drum cartridge OP (drum 1) to move due to vibrations or the like which occur, and therefore, for the drum 1 to be scarred, during the shipment of the image forming apparatus. On the other hand, if the pressing spring is increased in strength to prevent the drum cartridge OP (drum 1) from moving, the image forming apparatus increases in the amount of force necessary to open the front door 31, and therefore, reduces in usability.

In the case of the image forming apparatus 100 structured as described above, only one torsional coil spring 63 was employed to press both the drum cartridge OP and development cartridge DP. Therefore, it is ensured that there is a sufficient amount of contact pressure between the development roller 3*a* and the drum 1 of the corresponding drum cartridge OP when the development cartridge DP is in the state of developmental contact (development roller 3*a* is kept in contact with the drum 1).

Further, as the development cartridge DP is put in the state of developmental separation (development roller 3*a* of the development cartridge DP is separated from the drum 1 of the corresponding drum cartridge OP), the development cartridge DP moves the other end of the torsional coil spring 63. Therefore, the image forming apparatus 100 is increased in the amount of force for pressing the drum cartridge OP, ensuring that the apparatus is provided with a sufficient amount of force to press the drum cartridge OP to prevent the drum 1 from being scarred by the vibrations or the like while the image forming apparatus is transported (shipped), with cartridges installed in the apparatus main assembly 100A. That is, it is possible to provide the image forming apparatus with a sufficient amount of force for pressing the drum cartridges to prevent the development cartridges DP from moving due to the vibrations or the like which might occur during the transportation (shipment) of the apparatus, without reducing the apparatus in usability.

That is, by structuring the image forming apparatus 100 so that both the drum cartridge OP and development cartridge DP can be pressed by a single pressing spring (elastic member), it is possible to make the pressing force generated when the development cartridge DP is put in the state of developmental separation (development roller 3*a* of the development cartridge DP is in contact with the drum 1 of the corresponding drum cartridge OP), different from that when the development cartridge DP is in the state of developmental separation (development roller 3*a* is kept separated from the drum 1). More concretely, when the development cartridge DP is in the state of developmental contact, a sufficient amount of contact pressure, which is necessary to yield satisfactory images, is provided between the development roller 3*a* and drum 1, whereas as the development cartridge DP is in the state of developmental separation, one end of the pressing spring 63 is pressed by the retracting development cartridge DP. Therefore, the image forming apparatus is increased in the amount of force applied to the drum cartridge OP. As described above, according to this embodiment, both the amount of force necessary to provide a proper amount of contact pressure between the development roller 3*a* and drum 1 while the development cartridge DP is kept in state of developmental contact, and the amount of force necessary while the development cartridge DP is kept in the state of developmental separation, can be provided by the same (single) pressing spring 63.

As described above, in this embodiment, the image forming apparatus 100 is structured to employ the drum cartridges OP and development cartridges DP which are independent from each other, and the single spring 63 (elastic member) for pressing a pair of drum cartridge OP and development cartridge DP is shared by the drum cartridge OP and development cartridge DP. Therefore, it is possible to reduce an image forming apparatus in cost and size.

Further, as the development cartridge DP is put in the state of developmental separation, the greater amount of force is generated by the spring 63; the apparatus 100 is increased in the amount of force by which the drum cartridge OP is pressed to be positioned relative to the tray 250. Therefore, it becomes unlikely for the drum cartridge OP to be dislocated from the tray 250. That is, this embodiment is highly effective to prevent the problem that when the image forming apparatus 100 is shipped, with drum cartridges OP and development cartridges DP installed together in the apparatus main assembly 100A, the drums 1 are likely to be damaged.

Embodiment 2

Parts (a) and (b) of FIG. 12, FIG. 13, parts (a), (b) and (c) of FIG. 14 and parts (a)-(d) of FIG. 15 are drawings for describing the structure of the image forming apparatus in the second embodiment of the present invention. They correspond to parts (a)-(d) of FIG. 6, parts (a) and (b) of FIG. 7, parts (a)-(c) of FIG. 1 and parts (a)-(d) of FIG. 3, which are for describing the structure of the image forming apparatus 100 in the first embodiment.

In the first embodiment, the image forming apparatus 100 was structured so that the drum cartridge OP and development cartridge DP are removably installable in the apparatus main assembly 100A, independently from each other. In comparison, in the second embodiment 2 of the present invention, a single drum cartridge OP and a corresponding development cartridge DP are integrated as a process cartridge PP which is removably installable in the main assembly (100A) of the image forming apparatus (100). The development cartridge DP is held by the drum cartridge OP. More specifically, the casing of the drum cartridge OP is provided with a pair of drive side extension arm OPbR and non-drive side extension arm OPbL. The development cartridge DP is held by the pair of extension arms OPbR and OPbL between the two extension arms OPbR and OPbL, so that it is rotatable about the development flange 3*aR* and 3*a*L.

Since the image forming apparatus 100 in this embodiment is similar to the one in the first embodiment except for the structure and operation of the process cartridge PP mentioned above, the members and portions thereof of the image forming apparatus 100 in this embodiment, which are the same as the counterparts in the first embodiment, are given the same referential codes as those for the counterparts, and are not described.

Also in the case of the image forming apparatus in this embodiment, only a single coil spring was employed to press the drum cartridge OP and development cartridge DP of the process cartridge PP, as in the case of the image forming apparatus in the first embodiment, in which the development cartridge DP was independent from the drum cartridge OP. With the use of this structural arrangement, it is ensured that as the development cartridge DP is put in the state of developmental contact, contact pressure necessary for image formation is obtained.

As the development cartridge DP is put in the state of developmental separation, the development cartridge DP moves the other end of the torsional coil spring 63. Thus, the image forming apparatus is increased in the amount of force applied to the drum cartridge OP by the torsional coil spring 63. Therefore, it is ensured that the image forming apparatus applies a sufficient amount of pressing force upon the drum cartridge OP to prevent the problem that when the image forming apparatus is transported with the drum cartridges OP and development cartridges DP installed together in the apparatus main assembly 100A, the drum 1 is scarred by the vibrations or the like. That is, this embodiment also can provide an image forming apparatus which has a sufficient amount of force to keep the drum cartridges OP pressed to prevent the drum cartridges OP from moving due the vibrations of the like during the transportation of the image forming apparatus, and yet, has no less usability than any conventional image forming apparatus.

Embodiment 3

FIG. 16 shows a different version of the pressing mechanism 60 in the first and second embodiments. The pressing mechanism 60 in the third embodiment is structured so that cartridges are pressed by compression springs 63A. That is, this pressing mechanism 60 comprises compression springs 63*a*, first pressing members 62, and second pressing members 64. It presses each of drum cartridges OP and each of development cartridges DP.

In the first and second embodiments, the pressing mechanism 60 comprised the first pressing members 62, second pressing members 64, and torsional coil springs 63. However, effects similar to those obtainable by the first and second embodiments can be obtained by replacing the torsional coil springs with compression springs 63A. The details of this setup are described in the following.

Part (a) of FIG. 17 shows the state of one of combinations of drum cartridge OP, development cartridge DP, and pressing mechanism 60, in which the development cartridge DP is in contact with the drum cartridge OP, and part (b) of FIG. 17 shows that in which the development cartridge DP is remaining separated from the drum cartridge OP. The first pressing member 62 and second pressing member 64 are coaxially supported by the shaft 65 of the pressure stay 61. The first pressing member 62 and second pressing member 64 press the drum cartridge OP and development cartridge DP, respectively, by the force generated by the compression spring 64*a*.

That is, the compression spring 63A is between the first pressing member 62 and second pressing member 64. It presses both the drum cartridge OP and development cartridge DP through the pressing members 62 and 64, respectively. As the development roller 3*a* of the development cartridge DP is separated from the drum 1 of the corresponding drum cartridge OP by the moving mechanisms 70-73 (unshown, but similar to those in first and second embodiments) as shown in part (b) of FIG. 17, the second pressing member 64 rotates and compresses the compression spring 63A. Thus, the pressing force applied to the drum cartridge OP by the first pressing member 62 increases.

As described above, the compression spring 63A also can provide the same effects as those obtainable by the first and second embodiments.

Embodiment 4

FIG. 18 shows a different version of the pressing mechanism 60 in the first to third embodiments. The pressing mechanism 60 in the fourth embodiment is structured so that the force for pressing a cartridge is generated by a tensional spring 63B. That is, this pressing mechanism 60 comprises the tensional spring 63B, first pressing member 62, and second pressing member 64. It presses both the drum cartridge OP and development cartridge DP.

In the first and second embodiments, the torsional coil spring 63 was used as the source of the force for pressing cartridges, and in the third embodiment, the compression spring 63A was used. However, employing the tensional spring 63B as the source for generating the force for pressing cartridges can provide similar effects to those provided by the first, second and third embodiments. The following is the detailed description of this embodiment.

Part (a) of FIG. 19 shows the state of contact between the development cartridge DP and drum cartridge OP. Part (b) of FIG. 19 shows the state of the separation between the drum cartridge OP and development cartridge DP. The first and second pressing members 62 and 64 are coaxially supported by the shaft 65 of the pressure stay 61. The first and second pressing members 62 and 64 press the drum cartridge OP and development cartridge DP, respectively, with the use of the tensional force of the tensional springs 63B.

That is, there is provided the tension springs 63B between the first and second pressing members 62 and 64. The tension spring 63*b* presses both the cartridges OP and DP, through the pressing members 62 and 64, respectively.

Referring to part (b) of FIG. 19, as the development cartridge DP is put in the state of development separation by the moving mechanisms 70-73 (unshown: similar to those in Embodiments 1 and 2), the second pressing member 64 rotates, and therefore, the tension spring 63B is extended. Therefore, the pressing force applied to the drum cartridge OP by the first pressing member 62 increases.

As described above, effects similar to those provided by the first to third embodiments can be achieved also by the employment of the tensional spring 63*b* in place of torsional coil spring or compression spring.

«Others»

1) In the embodiments described above, the image forming apparatus 100 was structured so that the tray 250 is linearly movable in the direction parallel to the surface on which the apparatus main assembly 100A is placed. However, these embodiments are not intended to limit the present invention in terms of the direction in which the tray 250 is movable. That is, the present invention is also applicable to an image forming apparatus structured so that the tray 250 is linearly movable at an angle, for example, diagonally upward or downward.

2) In the embodiments described above, the image forming apparatus 100 was structured so that the tray 250 linearly moves in the direction perpendicular to the lengthwise direction of the cartridge (OP, DP and PP) which it supports. The lengthwise direction of the cartridge is a direction which is parallel to the lengthwise direction of the drum 1 or development roller 3*a*. However, the present invention is also applicable to an image forming apparatus 100 structured so that the tray 250 is linearly movable relative to the apparatus main assembly 100A, in the direction parallel to the lengthwise direction the cartridge.

3) Further, in the embodiments described above, the cartridge installation-uninstallation position is a position at which cartridges can be installed into, or uninstalled from, the tray 250. In terms of the direction in which the tray 250 is pulled out of the apparatus main assembly 100A, it is on the downstream side of the position in which cartridges can form images.

Further, the cartridge installation-uninstallation position is a position in which a user can pull any of the cartridges supported by the tray 250, out of the tray 250, from outside the apparatus main assembly 100A. It also is a position at which a user can make any of cartridges to be supported by the tray 250, from outside the apparatus main assembly 100A.

That is, the cartridge installation-uninstallation position does not need to be outside the apparatus main assembly 100A. It may be within the apparatus main assembly 100A, as long as it allows cartridges to be installed into, or uninstalled from, the tray 250.

4) The preceding embodiments are not intended to limit the present invention in the number of the drum cartridges OP to be supported by the tray 250 to four like the one in the preceding embodiments. That is, the present invention is also applicable to an image forming apparatus which employs two, three, five or more sets of drum cartridge OP and development cartridge DP, and an image forming apparatus which employs two, three, five or more process cartridges PP.

5) In the preceding embodiments, the image forming apparatus was an electrophotographic color image forming apparatus which employs two or more combinations of drum cartridge OP and development cartridge DP, or two or more process cartridges PP. These embodiments, however, are not intended to limit the present invention in terms of the number of combinations of drum cartridge OP and development cartridge DP, or the number of process cartridges PP. That is, the present invention is also applicable to a monochromatic image forming apparatus, which employs only one combination of drum cartridge OP and development cartridge DP, or only one process cartridge PP.

6) The present invention is also applicable to an image forming apparatus structured so that the unit 12 is movable relative to the tray 250 which is supporting combinations of drum cartridge OP and development cartridges DP, or process cartridges PP, to place the drum 1 and belt 13 in contact with each other, or separate the drum 1 and belt 13 from each other. It is also applicable to an image forming apparatus structured so that both the unit 12 and tray 250 are movable relative to each other.

7) The present invention is also applicable to an image forming apparatus which is similar in structure to those in the preceding embodiments, except that its unit 12 is a recording medium conveying transfer belt unit (ETB method) which holds and conveys a sheet of recording medium S. That is, in the preceding embodiments, the image forming apparatuses were of the so-called ITB type. However, the present invention is also applicable to an image forming apparatus of the so-called ETB type. The application of the present invention to an image forming apparatus of the ITB type also yields effects similar to those yielded by the preceding embodiments.

According to the present invention, both the development cartridge and drum cartridge are pressed by a single elastic member. Thus, the present invention can reduce an image forming apparatus in size. Further, it is possible to provide an image forming apparatus with a sufficient amount of force for keeping drum cartridges from moving due to the vibrations or the like which occur while the apparatus is transported, with its cartridges installed in the main assembly of the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-071422 filed on Apr. 3, 2018, which is hereby incorporated by reference herein in its entirety.

What is claimed is:

1. An image forming apparatus for forming an image on a recording material, said image forming apparatus comprising:

a main assembly;

a drum cartridge detachably mountable to said main assembly of said image forming apparatus, said drum cartridge having a photosensitive drum;

a developing cartridge detachably mountable to said main assembly, said developing cartridge including a developing member configured to carry a developer for developing a latent image on said photosensitive drum; and an urging mechanism provided in said main assembly and configured to urge said drum cartridge and said developing cartridge for positioning said drum cartridge and said developing cartridge inside said main assembly when said drum cartridge and said developing cartridge are mounted in said main assembly, wherein said urging mechanism includes:

an elastic member, a first urging member including a first urging portion configured to transmit a force of said elastic member to said drum cartridge, and a second urging member including a second urging portion configured to transmit the force of said elastic member to said developing cartridge.

2. An image forming apparatus for forming an image on a recording material, said image forming apparatus comprising:

a main assembly;

a process cartridge detachably mountable to said main assembly, said process cartridge integrally including a drum cartridge having a photosensitive drum, and a developing cartridge having a developing member configured to carry a developer for developing a latent image on said photosensitive drum; and an urging mechanism provided in said main assembly and configured to urge said drum cartridge and said developing cartridge for positioning said process cartridge inside said main assembly when said process cartridge is mounted in said main assembly, wherein said urging mechanism includes:

an elastic member, a first urging member including a first urging portion configured to transmit a force of said elastic member to said drum cartridge, and a second urging member including a second urging portion configured to transmit the force of said elastic member to said developing cartridge.

3. An apparatus according to claim 1, wherein one end portion of said elastic member contacts said first urging member, and the other end portion of said elastic member contacts said second urging member.

4. An apparatus according to claim 2, wherein one end portion of said elastic member contacts said first urging member, and the other end portion of said elastic member contacts said second urging member.

5. An apparatus according to claim 1, further comprising a moving mechanism configured to move said developing cartridge between a first position in which said developing member contacts said photosensitive drum and a second position in which said developing member is spaced from said photosensitive drum, wherein an urging force applied from said elastic member is stronger when said developing cartridge is in the second position than when said developing cartridge is in the first position.

6. An apparatus according to claim 2, further comprising a moving mechanism configured to move said developing cartridge between a first position in which said developing member contacts said photosensitive drum and a second position in which said developing member is spaced from said photosensitive drum, wherein an urging force applied from said elastic member is stronger when said developing cartridge is in the second position than when said developing cartridge is in the first position.

7. An apparatus according to claim 1, further comprising a tray supporting said drum cartridge and said developing cartridge, said tray being movable between an inside position which is inside said main assembly and an outside position which is outside said main assembly and in which said tray is capable of being drawn out, wherein when said tray is in the outside position, said drum cartridge and said developing cartridge are capable of being mounted and dismounted relative to said tray.

8. An apparatus according to claim 2, further comprising a tray supporting said drum cartridge and said developing cartridge, said tray being movable between an inside position which is inside said main assembly and an outside position which is outside said main assembly and in which said tray is capable of being drawn out, wherein when said tray is in the outside position, said drum cartridge and said developing cartridge are capable of being mounted and dismounted relative to said tray.

* * * * *